United States Patent [19]

Hayashi et al.

[11] Patent Number: 4,601,433

[45] Date of Patent: Jul. 22, 1986

[54] TOROIDAL CORE WINDING APPARATUS

[75] Inventors: Tsuneyuki Hayashi; Manabu Yamauchi; Kazuhide Tago, all of Tokyo; Toshio Konishi, Kanagawa; Shinji Hirai, Tokyo, all of Japan

[73] Assignee: Sony Corporation, Tokyo, Japan

[21] Appl. No.: 632,962

[22] Filed: Jul. 20, 1984

[30] Foreign Application Priority Data

Jul. 23, 1983 [JP] Japan ..... 58-134810

[51] Int. Cl.[4] ..... H01F 41/08

[52] U.S. Cl. ..... 242/4 R; 242/7.03; 364/468; 364/506

[58] Field of Search ..... 242/4 R, 4 A, 4 C, 703; 364/506, 468

[56] References Cited

U.S. PATENT DOCUMENTS 2,891,735 6/1959 Müller ..... 242/4 R 3,128,995 4/1964 Stütz ..... 242/4 R 4,424,939 1/1984 Ohashi et al. ..... 242/4 R

*Primary Examiner*—Billy S. Taylor

*Attorney, Agent, or Firm*—Hill, Van Santen, Steadman & Simpson

[57] ABSTRACT

An apparatus for winding a wire around a toroidal core is disclosed which includes a core holder for supporting the toroidal core, moving the same in the directions of first and second axes and rotating the same, first and second clamps for clamping one end of the wire, a clamp driver for holding the first and second clamps and moving the position thereof in the directions of the first and second axes and rotating the same, a wire holder positioned near the toroidal core for supporting the wire, a detector for detecting the position of the wire and the aperture of the toroidal core and a control device for controlling the core holder and the clamp driver by the output from the detector.

6 Claims, 59 Drawing Figures

CA1
CA2
C1
C2
P1
P2
W
H
TC
Ax1
Ax2
X
Y
Z

CA1
CA2
C1
C2
W
P1
P2
TC
Ax1
Ax2
X
Y
Z

FIG. 16A
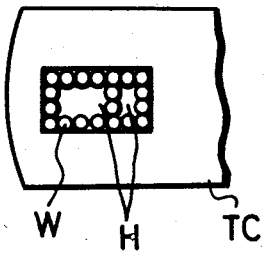
FIG. 16B
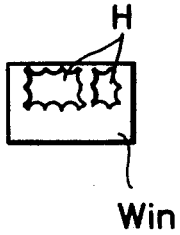
FIG. 17A
| | | |
|---|---|---|
| Q | Q | Q |
| Q | P | Q |
| Q | Q | Q |
FIG. 17B
| | | |
|---|---|---|
| 1 | 1 | 1 |
| 0 | 1 | 1 |
| 1 | 1 | 1 |
FIG. 17C
| | | |
|---|---|---|
| 1 | 1 | 1 |
| 0 | 0 | 1 |
| 1 | 1 | 1 |
FIG. 17D
| | | |
|---|---|---|
| 1 | 1 | 1 |
| 1 | 1 | 1 |
| 1 | 1 | 1 |
FIG. 17E
| | | |
|---|---|---|
| 1 | 1 | 1 |
| 1 | 1 | 1 |
| 1 | 1 | 1 |

TOROIDAL CORE WINDING APPARATUS

BACKGROUND OF THE INVENTION

1. Field of the Invention

The present invention generally relates to apparatus for winding a wire around a toroidal core and more particularly is directed to a novel apparatus capable of automatically winding a wire around a toroidal core so as to form a toroidal coil.

2. Description of the Prior Art

When a series of work for inserting a wire into an aperture of a toroidal core and winding the wire around the toroidal core to form a toroidal coil is carried out automatically, it may be considered that a free end portion of a wire is gripped by a proper holding means, the free end portion is faced to the aperture of a toroidal core, the holding means is moved in the direction of the aperture of core so as to insert the wire into the aperture of core, the free end portion of the wire passed through the aperture of core is gripped by another holding means, the free end portion of the wire is gripped again by the former holding means, and the toroidal core is rotated by one revolution whereby to wind the wire around the toroidal core once, which series of works are repeated several times to make a toroidal coil with a desired number of windings.

However, a toroidal core used by a magnetic head of a video tape recorder, an electric calculator and the like is very small so that when a wire is wound around such toroidal core, it is necessary to insert a wire into a quite small aperture of core. In this case, the free end portion of the wire held by the holding means easily bends, bringing about a great difficulty of inserting the wire into the aperture of core automatically. For this reason, in practice, the wire must be wound around the toroidal core by manual labor.

Further, when the free end portion of the wire is accurately positioned to the aperture of core of the toroidal core, it becomes necessary that a video camera is used to pick up the free end portion of the wire and the aperture of core and that a video signal is processed to detect the position of the aperture of core and that of the free end portion of the wire. When the position is detected, there is a serious problem that what portion of the aperture of core should be recognized as the position of the aperture of core. Because, the wire is very thin and its cross section is generally circular so that the center point of the free end surface of the wire is naturally recognized as the position of the wire. On the other hand, the aperture of core has an area and its shape is simple, for example, square in the first but becomes complicated as the winding process advances, so the optimum position at which the wire is inserted into the aperture of core changes incessantly. Accordingly, if such control of the position is not carried out that the optimum position at which the wire is inserted into the aperture of core is recognized as the position of the aperture of core, an extremely small error in positioning based on the limit of accuracy of the winding apparatus or the like causes the wire to be positioned at a position displaced from the aperture of core and hence there is then some fear that the wire can not be inserted into the aperture of core or that in some case the winding apparatus does not work well. Thus, it is necessary to detect the optimum wire insertion position of the aperture of core and to recognize it as the position of the aperture of core.

OBJECTS AND SUMMARY OF THE INVENTION

Accordingly, it is an object of the present invention to provide an improved apparatus for winding a wire around a toroidal core.

It is another object of the present invention to provide an apparatus for winding a wire around a toroidal core capable of preventing a wire held by a holding means used to insert the wire into an aperture of a toroidal core from bending.

It is a further object of the present invention to provide an apparatus for winding a wire around a toroidal core capable of continuously carrying out the winding of several turns smoothly.

It is a still further object of the present invention to provide a method of detecting a proper position at which an object is inserted into an aperture, a clearance and the like.

According to one aspect of the present invention, there is provided an apparatus for winding a wire around a toroidal core includes a core driving means for holding a toroidal core such that an axis of its aperture is made in parallel to X-axis direction, moving the core in X-axis direction and Z-axis direction and rotating the same around Y-axis in clockwise or counter-clockwise direction, a clamp driving means for holding first and second clamps which hold a free end portion of a wire at the position displaced from the center of rotation on one rotary surface vertical to the Y-axis and properly spaced apart from each other in its radius direction, rotating the two clamps with a constant positional relation therebetween in the clockwise or counter-clockwise direction and moving the same in the X-axis direction and Z-axis direction, a first pulley located at the position properly spaced apart to one side along the X-axis direction from the toroidal core held by the core driving means and changed in position by a position control section, a second pulley located at the opposite side to the first pulley with respect to the toroidal core held by the core driving means and changed in position by the position control section, a first video camera located at the side opposite to the toroidal core along the X-axis direction with respect to the first pulley and a second video camera located at the side opposite to the toroidal core with respect to the second pulley. The clamp driving means is formed to be capable of driving the first and second clamps to open and to close independently, driving the first clamp to move in the X-axis direction and the Y-axis direction and driving the second clamp to move in the Y-axis direction. The first and second video cameras are disposed in such a manner that their optical axes are both in parallel to the X-axis and that they are spaced apart from each other by a predetermined distance therebetween in the Z-axis direction. Then, the free end portion of the wire held by the first clamp and the aperture of the toroidal core are picked up by the first and second video cameras so as to detect the positions thereof.

According to another aspect of the present invention, there is provided a method for detecting a proper insertion position upon inserting a material into an aperture, a clearance or the like, which comprises the steps of picking up a picture of an aperture, a clearance and so on, converting a signal obtained by the pick-up to the form of a binary coded signal to provide such picture image data formed of the binary coded video signal of large number bits which consists of one signal representing the aperture, clearance and the like and the other signal representing other portion than the aperture, clearance and the like, when there exists even one bit in the signals representing other portion than the aperture, clearance and the like within a rectangular area of m×n bits (m and n are both desired integers and m =n may be possible) for the picture image data, changing a particular bit previously determined within the rectangular area to a signal representing other portion than the aperture, clearance and the like regardless of the content of the signal over the whole area of the picture image data with the position of the rectangular area being changed in turn to thereby shrink the aperture, clearance and the like on the picture image data, repeating the shrinking process until the aperture on the picture image data is lost, and selecting one bit from the bits remaining as the signal representing the aperture, clearance and the like on the picture image data at the step just before the aperture, clearance and so on are lost, whereby to recognize the position of that bit as a proper position at which the material is inserted into the aperture, clearance and the like.

The other objects, features and advantages of the present invention will become apparent from the following description taken in conjunction with the accompanying drawings through which the like references designate the same elements and parts.

BRIEF DESCRIPTION OF THE DRAWINGS

FIGS. 16A and 16B are respectively diagrams useful for explaining the aperture of core being divided, in which FIG. 16A shows the portion of the toroidal core picked up by a video camera, while FIG. 16B shows the picture image data within the window;

FIGS. 17A to 17E are respectively diagrams useful for explaining a method of shrinking an aperture of core, in which FIG. 17A shows a square area of 3×3 bits which undergoes the processing for calculating a logical multiplication, FIG. 17B shows an example in which bit "0" exists within the square area, FIG. 17C shows the square area shown in FIG. 17B after being subjected to the processing for changing the center picture element in accordance with the content of the logical multiplication, FIG. 17D shows an example in which no bit "0" exists within the square area, and FIG. 17E shows a case in which the center picture element is not changed although the area shown in FIG. 17D underwent the processing for changing the center picture element in accordance with the content of logical multiplication;

DESCRIPTION OF THE PREFERRED EMBODIMENTS

Figure 1:
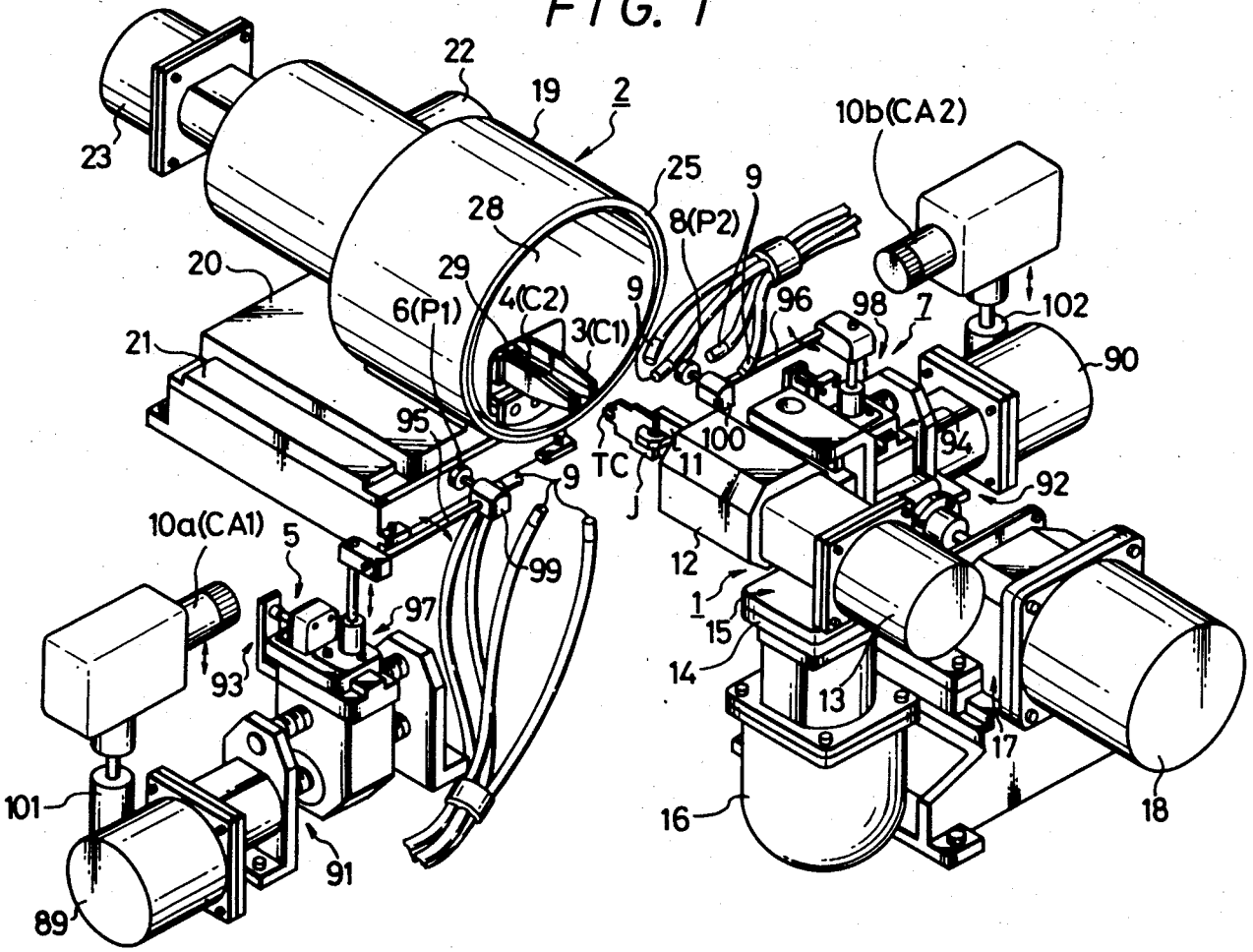
FIG. 1 is a perspective view showing the whole of mechanism sections of an embodiment of an apparatus for winding a wire around a toroidal core according to the present invention.

Now, one embodiment of an apparatus for winding a wire around a toroidal core according to this invention will hereinafter be described in detail with reference to the drawings. FIG. 1 is a perspective view showing an overall arrangement of the mechanism sections of the winding apparatus of the invention.

In FIG. 1, reference numeral 1 generally designates a core driving mechanism for rotating a toroidal core TC around X-axis and for moving it to Z-axis direction perpendicular to the X-axis and Y-axis direction perpendicular to the X-axis. Reference numeral 2 generally designates a clamp driving mechanism for driving a first clamp 3(C1) and a second clamp 4(C2) to hold a wire W which enters an aperture H of a core of the toroidal core TC. Reference numeral 5 generally designates a first pulley holding mechanism for holding a first pulley 6(P1). Reference numeral 7 generally designates a second pulley holding mechanism for holding a second pulley 8(P2). Reference numerals 9, 9, . . . designate lamps for irradiating the toroidal core TC and the free end of the wire W. Reference numerals 10*a* and 10*b* designate video cameras (CA1 and CA2) used for detecting the position of the free end of the wire W and of the aperture H of the toroidal core TC.

Figure 2:
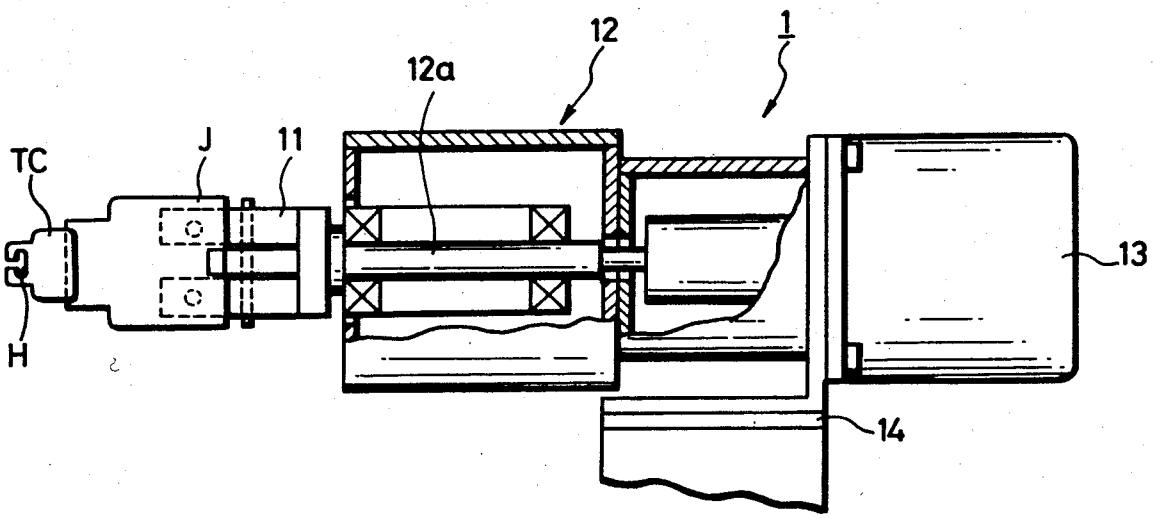
FIG. 2 is a side view of a core driving mechanism used in the embodiment of the present invention shown in FIG. 1.

FIG. 2 shows a main part of the core driving mechanism 1 illustrated in FIG. 1. In FIG. 2, reference numeral 11 designates a core holding member for holding a jig J which holds the toroidal core TC. The core holding member 11 is fixed to a rotary shaft 12*a* of a head rotor 12 at its opposite end surface to the end surface on which the jig J is held. The core holding member 11 normally holds the toroidal core TC through the jig J so as to make the axis of the aperture H become parallel to the X-axis and is rotated 360° around the Y-axis by the head rotor 12. Reference numeral 13 designates a pulse motor used as a drive source for the head rotor 12 and 14 a pedestal or base used to support the head rotor 12 and the pulse motor 13. The main part of the core driving mechanism 1 that is supported by the pedestal 14 as shown in FIG. 2 is moved in the Z-axis direction and the Y-axis direction by an elevating mechanism and a moving or shifting mechanism which will be described below. Turning back to FIG. 1, reference numeral 15 designates an elevating mechanism for moving the pedestal 14 in the vertical direction, or the Z-axis direction. Reference numeral 16 designates a pulse motor which serves as a drive source for the elevating mechanism 15. Reference numeral 17 designates a shifting mechanism for shifting the elevating mechanism 15 in the Y-axis direction, and 18 a pulse motor serving as a drive source for the shifting mechanism 17.

Thus the core driving mechanism 1 is capable of rotating the toroidal core TC around the Y-axis by driving the pulse motor 13, or shifting it in the Z-axis direction by driving the pulse motor 16 and of shifting it in the Y-axis direction by driving the pulse motor 18.

The clamp driving mechanism 2 is used to drive the first and second clamps 3(C1) and 4(C2). Reference numeral 19 designates a clamp driving section for driving the two clamps 3(C1) and 4(C2) and which is supported on a base 20. The base 20 is supported on a support guide member 21 so as to be slidable in the X-axis direction and moved in the X-axis direction by the shifting mechanism (not shown) which uses a pulse motor 22 as its driving source. Reference numeral 23 designates a driving pulse motor for rotating a rotary housing of the clamp driving section 19 as will be described later and for rotating a cam, which will also be described later, so as to independently drive the first and second clamps 3(C1) and 4(C2).

Figure 3:
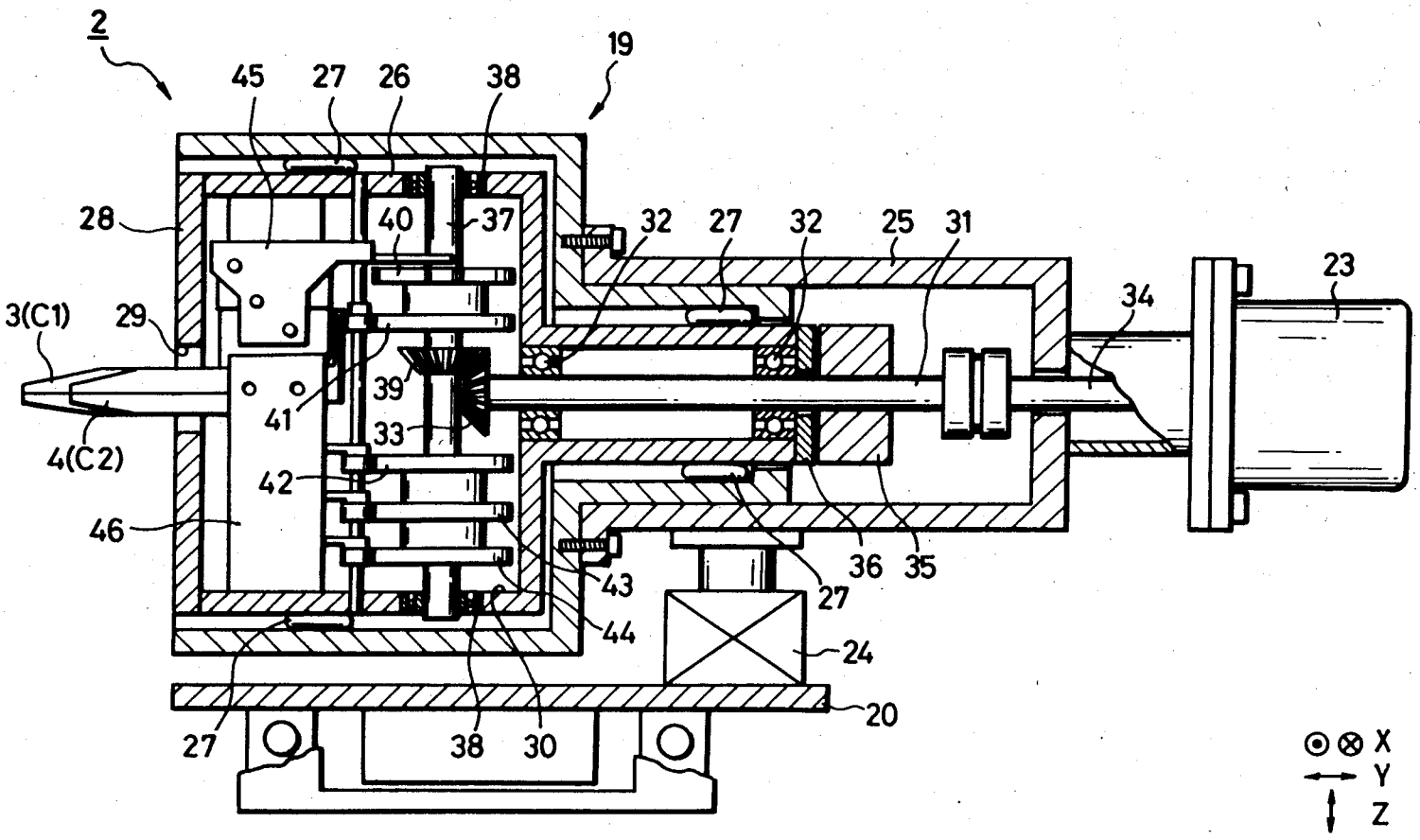
FIG. 3 is a longitudinal cross-sectional view of a clamp driving mechanism used therein.
Figure 4:
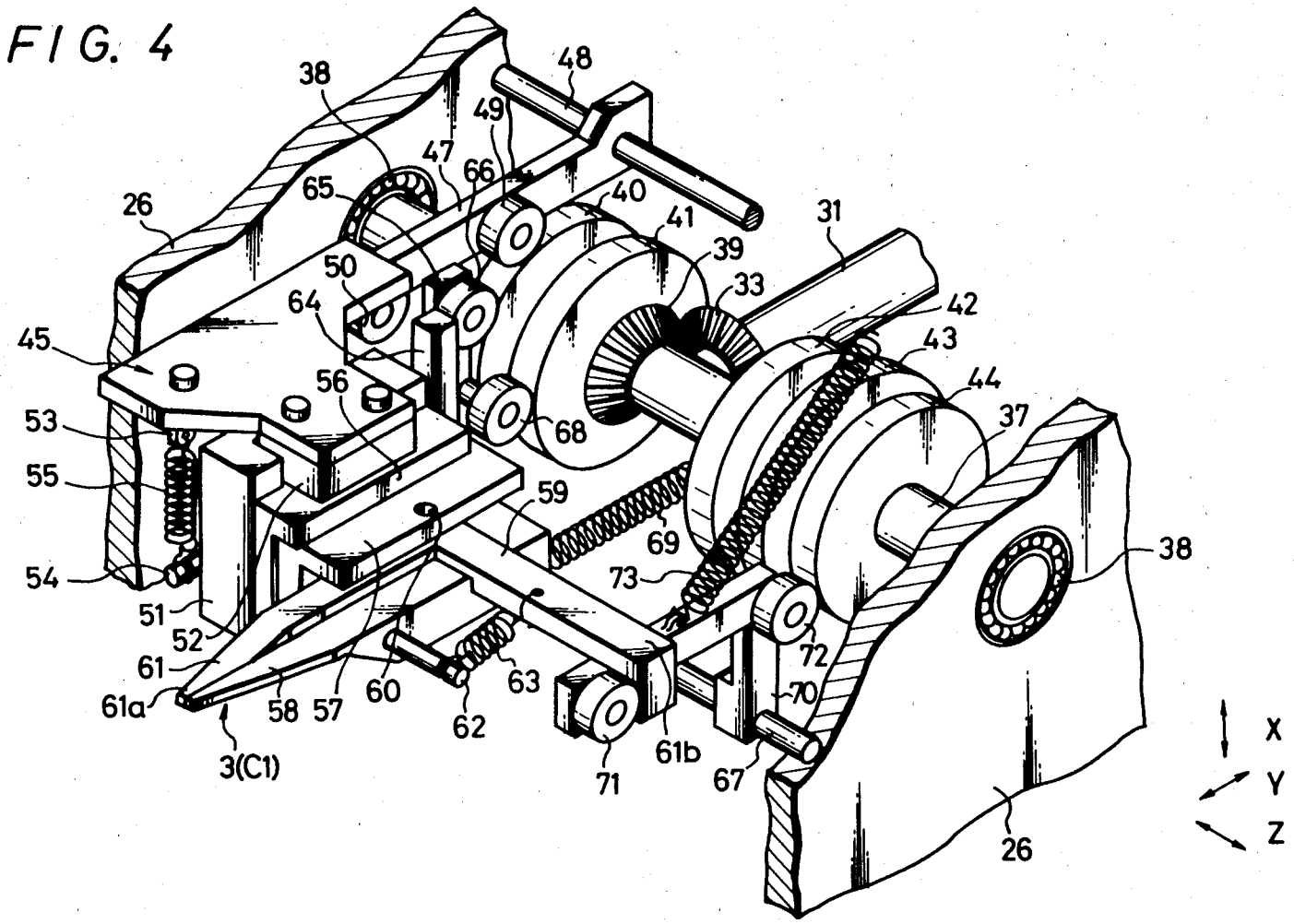
FIG. 4 is a perspective view showing a driving section for driving a first clamp in the form of being extracted from the clamp driving mechanism.
Figure 5:
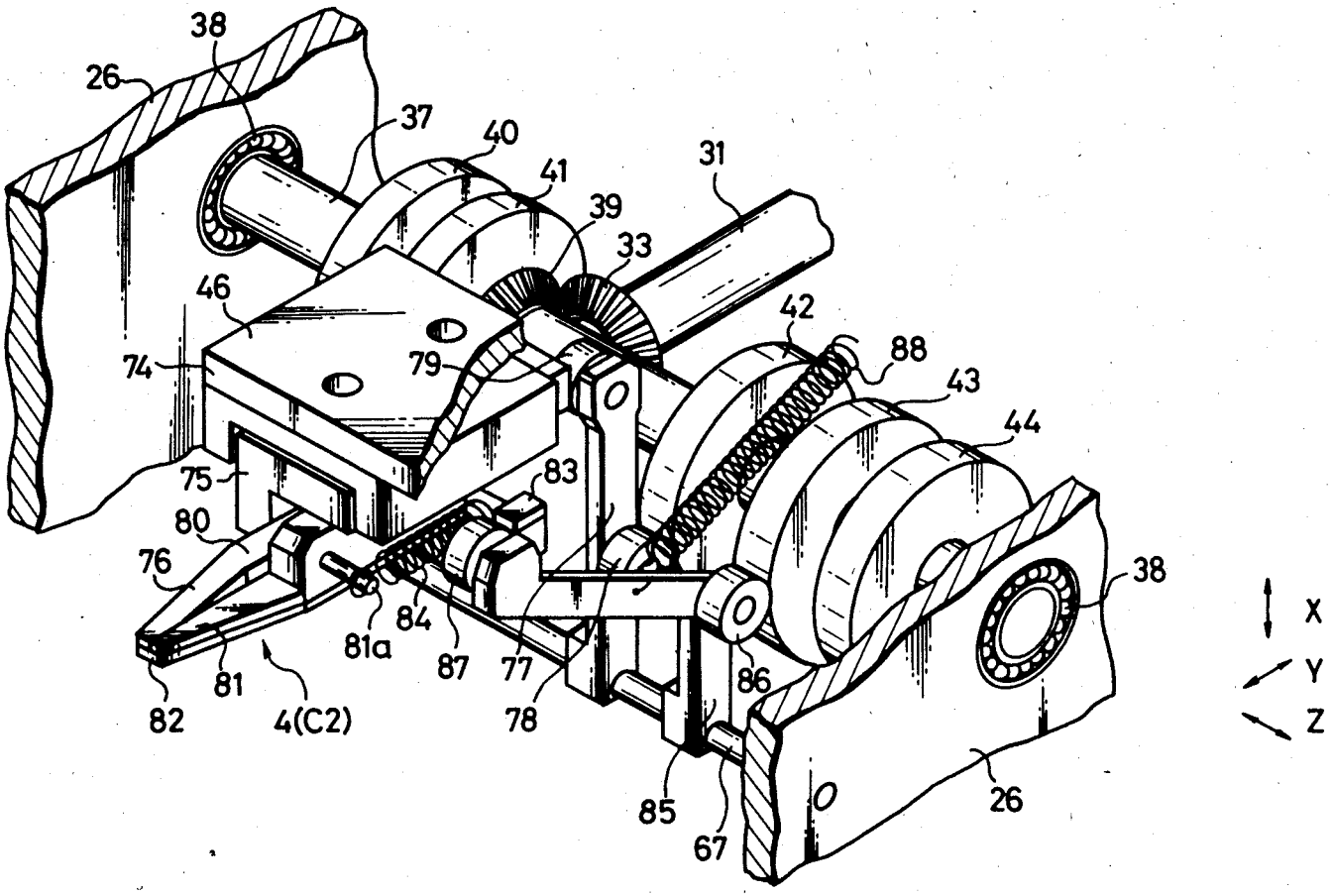
FIG. 5 is a perspective view showing a driving section for driving a second clamp in the form of being extracted from the clamp driving mechanism.

FIGS. 3 to 5 are respectively diagrams showing the inside structure of the clamp driving section 19. In FIG. 3, reference numeral 24 designates a cylinder which is disposed on the base 20 to supportably move the clamp driving section 19 in the Z-axis direction. Reference numeral 25 designates a casing of cylindrical shape for the clamp driving section 19 and which is made large in the diameter of its front half portion and made small in the diameter of its rear half portion. Reference numeral 26 designates a rotary housing of cylindrical shape made large in the diameter of its front half portion and small in the diameter of its rear half portion and which is rotatably disposed within the casing 25 through bearings 27, 27. More specifically, the large-diameter front half portion of the rotary housing 26 is located within the large-diameter front half portion of the casing 25 and the small-diameter rear half portion of the rotary housing 26 is located within the small-diameter rear half portion of the casing 25. The front opening of the rotary housing 26 is closed by a front cover 28, and reference numeral 29 designates a window formed through the front cover 28. Through this window 29, the clamps 3(C1) and 4(C2) are protruded forward from the rotary housing 26. The inside of the front half portion of the rotary housing 26 makes a room for a clamp compartment 30.

Reference numeral 31 designates a rotary shaft rotatably supported by the rotary housing 26 through bearings 32, 32 so as to pass through the rear half portion of the rotary housing 26 along its axis. The rotary shaft 31 is provided with a bevel side gear 33 at its front end positioned within the clamp compartment 30, and the rear end thereof extended backward from the rotary housing 26 is coupled to a drive shaft 34 of the pulse motor 23. Reference numeral 35 designates a rotor of a clutch disposed at the rear side of the rotary housing 26. This rotor 35 is engaged with the rotary shaft 31 so as to rotate together with the same and to be movable along the axial direction of the rotary shaft 31. When a clutch (not shown) is made contact, the rotor 35 is pressed against a disc 36 which is fixed to the rear end surface of the rotary housing 26, thereby transmitting the rotation of the rotary shaft 31 through the rotor 35 and the disc 36 to the rotary housing 26.

Reference numeral 37 designates a cam shaft disposed within the clamp compartment 30 and which is rotatably supported by a pair of bearings 38, 38 positioned at the opposite sides to each other with respect to the axis of cam shaft 37 in the peripheral wall of the rotary housing 26. Thus the cam shaft 37 is oriented in the direction perpendicular to the axis of the rotary housing 26. A bevel side gear 39 is fixed to the cam shaft 37 at its substantially center portion and then engaged with the bevel side gear 33. Reference numerals 40 to 44 respectively designate cams fixed to the cam shaft 37 and the cams 40 to 44 serve to drive the first and second clamps 3(C1) and 4(C2) supported by a first clamp support base 45 and a second clamp support base 46.

FIG. 4 shows a mechanism of driving the first clamp 3(C1) which is extracted from the main part of the clamp driving mechanism 2. This mechanism for driving the first clamp 3 (C1) will hereinafter be described with reference to FIG. 4.

In FIG. 4, reference numeral 47 designates a cam lever for driving the first clamp 3(C1) to move in the X-axis direction. The cam lever 47 is rotatably supported at its one end by a support shaft 48 and provided at its middle portion and rotary end portion on its one side surface with rollers 49 and 50. The roller 50 mounted to the rotary end portion of the cam lever 47 is made in contact with the surface of the first clamp support base 45 at the side of the clamp 3, while the roller 49 mounted to the middle portion of the cam lever 47 is in contact with the first cam 40. Reference numeral 51 designates a guide member for holding a slide member 52 of the first clamp support base 45 so as to be slidable in the X-axis direction. The guide member 51 is fixed to the rotary housing 26. A spring engaging pin or protrusion 54 is fixed to the guide member 51 and between the spring engaging protrusion 54 and a spring engaging pin or protrusion 53 attached to the first clamp support base 45 is stretched a spring 55 by which the first clamp support base 45 is biased to orient to the underside of FIG. 4 along the X-axis direction. Reference numeral 56 designates a guide member mounted on the slide member 52 to hold a slide member 57 so as to be movable in the Y-axis direction. On the side of the slide member 57 opposite to the guide member 51 is formed a fixed member 58 which constructs a part of the first clamp 3(C1). A movable member 59 makes a pair with the fixed member 58 to construct the first clamp 3(C1), formed as substantially L-shape and rotatably supported at its corner portion by a support shaft 60 fixed to the slide member 57. The movable member 59 is rotated so as to allow its one piece member 61*a* to be in contact with or to be released from the fixed member 58. From the side surface of the fixed member 58 is protruded a spring engaging pin or protrusion 62 and between the spring engaging protrusion 62 and the other piece member 61*b* of the movable member 59 is stretched a spring 63 which bias the movable member 59 to be rotatable so as to open the first clamp 3(C1).

Reference numeral 64 designates a follow-up member fixed to the slide member 57 so as to extend to the upper side of FIG. 4 along the X-axis direction, and which is in contact with a roller 66 attached to a cam lever 65 at its rotatary end portion. The cam lever 65 is rotatably supported at its one end to a support shaft 67 fixed to the rotary housing 26 and provided at its rotary end portion with the roller 66 as mentioned before and also at its middle portion with a roller 68. The roller 68 is made in contact with the second cam 41. Reference numeral 69 designates a spring for biasing the fixed member 58 to move backward along the Y-axis direction. As a result, by the rotation of the second cam 41, the first clamp 3 (C1) is moved in the Y-axis direction.

Reference numeral 70 designates a cam lever of L-shape capable of opening and closing the first clamp 3 and which is rotatably supported at its one end to the support shaft 67. The cam lever 70 is provided at its rotary end portion with a roller 71 and at its corner portion with a roller 72. The roller 71 is made in contact with the front surface of the other piece member 61*b* of the movable member 59 and the roller 72 is made in contact with the fifth cam 44. A spring 73 biases the cam lever 70 in the rotary direction to make the roller 72 contact with the cam 44. Thus, when the roller 72 is moved forward by the cam 44, the first clamp 3(C1) is opened by the spring force of the spring 63, while when the roller 72 is moved backward, the first clamp 3(C1) is closed to hold the wire W.

As described above, the first clamp 3(C1) is moved in the X-axis direction by the first cam 40, moved in the Y-axis direction by the second cam 41 and controlled to open and close by the fifth cam 44. The third and fourth cams 42 and 43 do not take part in the operation of the first clamp 3(C1).

FIG. 5 shows a section for driving the second clamp 4(C2) which is extracted from the main part of the clamp driving mechanism 2. The mechanism of this section for driving the second clamp 4(C2) will hereinafter be described with reference to FIG. 5. As shown in FIG. 5, the second clamp support base 46 for supporting the second clamp 4(C2) is fixed to the rotary housing 26. In this case, the second clamp support base 46 is fixed to the rotary housing 26 at the end surface of the lower right-hand side in FIG. 5, and the portion to be fixed is cut out for convenience and not shown in FIG. 5. Reference numeral 74 designates a guide member for the support base 46 and which holds a slide member 75 so as to be slidable in the Y-axis direction. On the lower surface of the slide member 75 in FIG. 5 is rotatably supported a movable piece member 76 of L shape which constructs a part of the second clamp 4(C2) through a support shaft not shown.

Reference numeral 77 designates a cam lever by which the slide member 75 is moved along the Y-axis direction. This cam lever 77 is rotatably supported at its one end to the support shaft member 67 and provided at its middle portion and rotary end portion with rollers 78 and 79. The roller 78 attached to the middle portion of the cam lever 77 is made in contact with the third cam 42 and the roller 79 attached to the rotary end portion of the cam lever 77 is made in contact with the rear end surface of the slide member 75. The slide member 75 is biased to move backward along the Y-axis direction by a spring not shown so that the slide member 75 is always kept in contact with the roller 79 of the cam lever 77. Consequently, as the third cam 42 rotates, the slide member 75 and the second clamp 4 are moved in the Y-axis direction.

The movable piece member 76 of L-shape constructing a part of the second clamp 4(C2) is capable of holding the wire W between its long piece member 80 and a fixed piece member 81 fixed to the slide member 75. Reference numeral 82 designates a guide member fixed to the fixed piece member 81 and which is provided at its portion between the long piece member 80 of the movable piece member 76 and the fixed piece member 81 with a guide aperture (not shown) for introducing the wire W. Reference numeral 83 designates a short piece member of the movable piece member 76 of L shape, and between the short piece member 83 and a spring engaging protrusion or pin 81*a* protruded from the side surface of the fixed piece member 81 is stretched a spring 84. Reference numeral 85 designates a cam lever which opens and closes the second clamp 4(C2). This cam lever 85 bends like inverse L-shape and supported at its one end to the support shaft 67 so as to rotate freely. Rollers 86 and 87 are respectively attached to the bent portion and rotary end portion of the cam lever 85. The roller 86 attached to the bent portion of the cam lever 85 is made in contact with the fourth cam 43, while the roller 87 attached to the tip end portion thereof is made in contact with the front surface of the short piece member 83 of the movable piece member 76. Reference numeral 88 designates a spring by which the cam lever 85 is biased to make the roller 86 contact with the fourth cam 43.

Accordingly, when the roller 86 is moved forward against the spring 88 by the fourth cam 43, the movable piece member 76 having the short piece member 83 being in contact with the roller 87 is rotated by the spring force of the spring 84 so as to be spaced apart from the fixed piece member 81 so that the second clamp 4(C2) is opened. Contrary to the above, when the roller 86 of the cam lever 85 is moved backward, the second clamp 4(C2) is closed, or set in its holding state. As described abbve, the second clamp 4(C2) can be opened and closed by the fourth cam 43.

The first clamp 3(C1) and the second clamp 4(C2) are disposed so as to be spaced apart in the radius direction at the position displaced from the center of rotation of the rotary housing 26.

When the electromagnetic clutch is closed to rotate the rotary housing 26, the transmission shaft 31 is rotated together with the rotary housing 26, so the transmission shaft 31 is stopped relative to the rotary housing 26. As a result, the cam shaft 37 is kept still when the rotary housing 26 is rotated, so that without changing the state of the first and second clamps 3(C3) and 4(C3), the rotary housing 26 can be rotated.

As described above, the explanation of the clamp driving mechanism 2 will be ended.

Turning back to FIG. 1, the first and second pullery holding mechanisms 5 and 7 respectively include moving mechanisms 91 and 92 having pulse motors 89 and 90 to move the pulleys 6(P1) and 8(P2) along the X-axis direction, moving mechanisms 93 and 94 for moving the same along the Y-axis direction, and rotating and elevating mechanisms 97 and 98 for moving the same in the Z-axis direction and rotating support arms 95 and 96 which support the pulleys 6 and 8. The pulleys 6(P1) and 8(P2) are respectively supported to the tip ends of the support arms 95 and 96, which are driven by the rotating and elevating mechanisms 97 and 98, through support members 99 and 100 so as to be vertical and rotatable.

The video cameras 10*a*(CA1) and 10*b*(CA2) are respectively supported by elevating apparatus 101 and 102 which move the same in the Z-axis direction.

OPERATION EXAMPLE

FIG. 6 schematically shows one operation example of the winding apparatus and in which the condition of its main parts is changed in the order of operations.

Figures 6A, 6B, 6C, 6D, 6E, 6F, 6G, 6H, 6I:
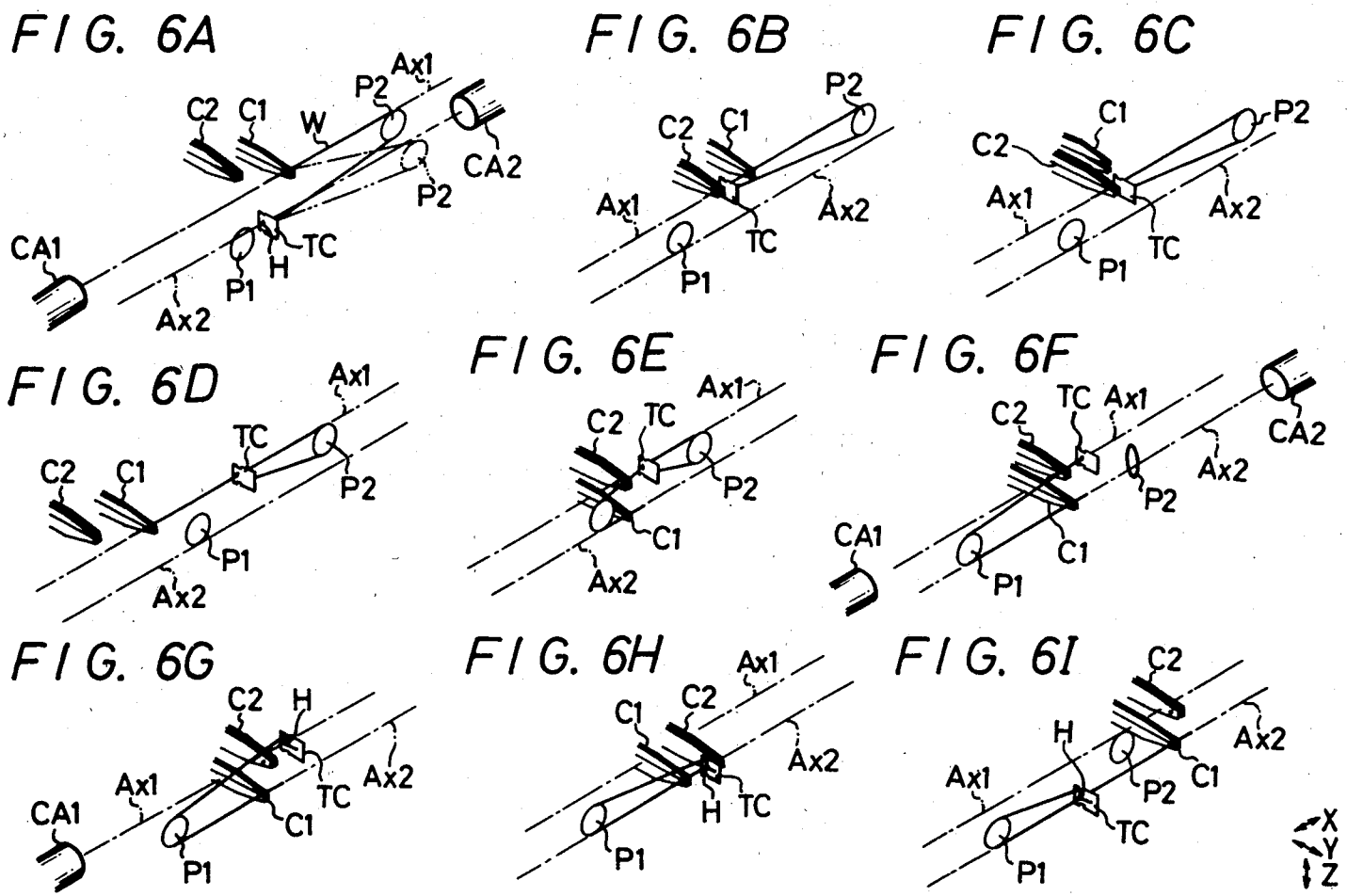
FIGS. 6A to 6Q are respectively perspective views showing the change of the main part in an example of operation of the winding apparatus in the right order of operation.

(1) FIG. 6A shows the operation initiation condition of the winding apparatus in the operation cycle in which the wire W is wound once. Reference Ax1 represents the optical axis of the first video camera CA1 and reference Ax2 represents the optical axis of the second video camera CA2. The two optical axes Ax1 and Ax2 are both in parallel to the X-axis direction and the optical axis Ax1 is positioned above the optical axis Ax2 with a predetermined distance therebetween. The toroidal core TC is controlled by the core driving mechanism 1 to become vertical to the optical axis Ax2 and to allow its aperture H to be placed on substantially the focus of the second video camera CA2. The wire W fixed at its one end to the toroidal core TC (or the jig J holding the toroidal core TC) is wound around the second pulley P2, extended from the second pulley P2 along the optical axis Ax1 and gripped by the first clamp C1 at the position distant from its free end by a predetermined length. The second clamp C2 is properly spaced apart from the optical axis Ax1 along the Y-axis direction in the upper left-hand side in FIG. 6, or the second clamp C2 is behind from the optical axis Ax1. The first pulley P1 also spaced apart from the optical axis Ax2 at the position in the lower right-hand side of FIG. 6 along the Y-axis direction, or the first pulley P1 is below the optical axis Ax2.

Under the above condition, the first video camera CA1 picks up the state to detect the position of the free end portion of the wire W gripped by the first clamp C1. Then, the second video camera CA2 picks up the state to detect the position of the aperture H of the toroidal core TC. In this case, in order to prevent the second pulley P2 from obstructing the picking-up by the video cameras, the position of the second pulley P2 is displaced as shown by a two-dot chain line only during the period in which the video cameras pick up the state. After the video cameras end their picking-up, the second pulley 2 is moved to the original position shown by a solid line in FIG. 6A.

When the first and second video cameras CA1 and CA2 take pictures, their picture signals are processed in calculation by a control apparatus, which will be described later, so as to detect the positions of the aperture H and the tip end of the wire W.

(2) The rotary housing 26 of the clamp driving mechanism 2 (not shown in FIG. 6), or the first and second clamps C1 and C2 are both moved a little to the side of the second camera CA2 along the X-axis direction. At the same time, the first pulley P1 which was moved from the optical axis Ax2 to the lower right-hand side along the Y-axis direction, or which was behind the optical axis Ax2 is moved forward to the optical axis Ax2. Then, the second clamp C2 is moved forward so as to place the center of the guide aperture thereof on the optical axis Ax1.

Then, the toroidal core TC is moved upwards along the Z-axis direction to be positioned in such a manner that the position of the aperture H, when seen from the side of the first video camera CA1, may coincide with the position of the free end portion of the wire W in the Y-axis direction. Thereafter, the first clamp C1 is moved by a predetermined amount to the side of the first video camera CA1 along the X-axis direction and the free end portion of the wire W gripped by the clamp C1 is passed through the aperture H and the second clamp C2. Then, the second clamp C2 is closed to hold the wire W at the free end portion thereof. FIG. 6B shows that state.

(3) Then, the first clamp C1 is opened and then moved backward from the optical axis Ax1 as shown in FIG. 6C.

(4) The first and second clamps C1 and C2 are both moved by a predetermined amount along the X-axis direction to the side of the first video camera CA1 so that the wire W held by the second clamp C2 is moved to the side of the first video camera CA1 in correspondence therewith. Then, as the free end portion of the wire W is moved to the side of the first video camera CA1, the second pulley P2 is also moved to the side of the first video camera CA1.

The first clamp C1 is moved forward when it comes closer to the first video camera CA1 than the toroidal core TC on its way of being moved, so that the free end portion of the wire W moving along the optical axis Ax1 is passed through the first clamp C1 (namely, the space between the fixed piece member 58 and the movable piece member 59). Thereafter, the clamp C1 is closed and then the second clamp C2 is moved to the side of the first video camera CA1 so as to be apart from the first clamp C1 so that the wire W is released from the aperture H of the toroidal core TC. After the wire W is held by only the first clamp C1 as described above, the second clamp C2 is moved backward. FIG. 6D shows that state. The operation by which the wire W is held from the second clamp C2 to the first clamp C1 is carried out in the period during which the rotary housing 26 holding therein the first and second clamps C1 and C2 is moved along the X-axis direction.

(5) The rotary housing 26 is moved below along the Z-axis direction after having been moved along the X-axis direction so that the center of the rotation of the rotary housing 26 is changed in height from the optical axis Ax1 to the optical axis Ax2. Then, the rotary housing 26 is rotated 180° in the counter-clockwise direction and then the first clamp C1 is placed on the optical axis Ax2, while the second clamp C2 is disposed at the position a little backward from the optical axis Ax2. Accordingly, when the rotary housing 26 is rotated, the wire W held by the first clamp C1 is brought to such a state that its end portion wound around the first pulley P1 is placed on the optical axis Ax2. At the same time of this rotation, the second pulley P2 around which the wire W is wound is moved along the X-axis direction to the side of the first video camera CA1 to prevent the wire W from being applied with a tension higher than a predetermined tension. FIG. 6E shows that state.

(6) As the first pulley P1 is moved along the X-axis direction to the side of the first video camera CA1, also the second pulley P2 is moved to the side of the second video camera CA2. In the middle step of such movement, the support arm 96 supporting the first pulley P1 is rotated so as to release the wire W from the second pulley P2. Thereafter, the second pulley P2 is moved in the lower right-hand side in FIG. 6 along the Y-axis direction to become apart from the optical axis Ax2. FIG. 6F shows that state.

(7) Then, the toroidal core TC is rotated 180° in the clockwise direction so that the wire W is wound around the toroidal core TC. At the same time, the rotary housing 26 is moved backward along the Y-axis direction.

Thereafter, the photograph of the aperture H of the toroidal core TC is taken by the first video camera CA1, and FIG. 6G shows that state.

(8) The toroidal core TC is moved along the Z-axis direction to the lower side so as to place its aperture H on substantially the optical axis Ax2. Further, the position of the toroidal core TC is finely adjusted in such a manner that the position of the aperture H may coincide with the position of the free end of the wire W.

(9) Operations as shown in FIGS. 6B to 6G will hereinafter be repeated the number of times corresponding to the number of windings of the toroidal coil. Each time a series of operations as shown in FIGS. 6B to 6G are repeated, the direction in which the wire W is inserted into the aperture H of the toroidal core TC is reversed.

FIG. 6H shows a state that the wire W will be inserted into the aperture H of the toroidal core TC from the side of the first video camera CA1. FIG. 6I shows a state that the wire W is inserted into the aperture H from the side of the first video camera CA1, and FIG. 6J shows a state just a little before the wire W is inserted into the aperture H of the toroidal core TC from the side of the second video camera CA2.

Figure 7A:
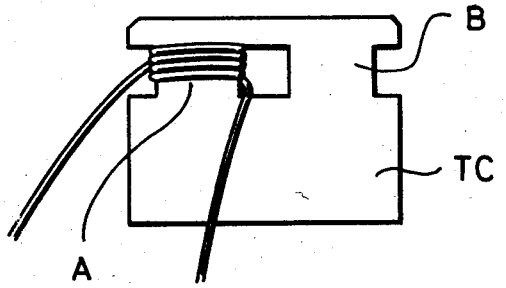
FIGS. 7A and 7B are respectively plan views showing a toroidal coil having a toroidal core around which a wire is wound in the lateral direction.
Figure 7B:
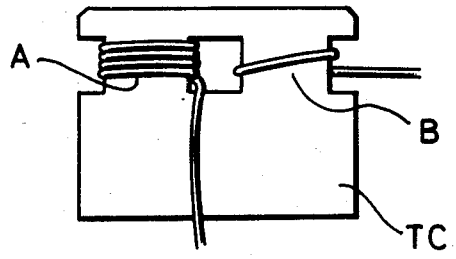

According to the above operation, the wire W is wound around a portion A of the toroidal core TC as shown in FIG. 7A. When winding the wire W around a portion B after the portion A as shown in FIG. 7B, the following operations (10) to (14) will be carried out.

Figures 6J, 6K, 6L, 6M, 6N, 6O, 6P, 6Q:
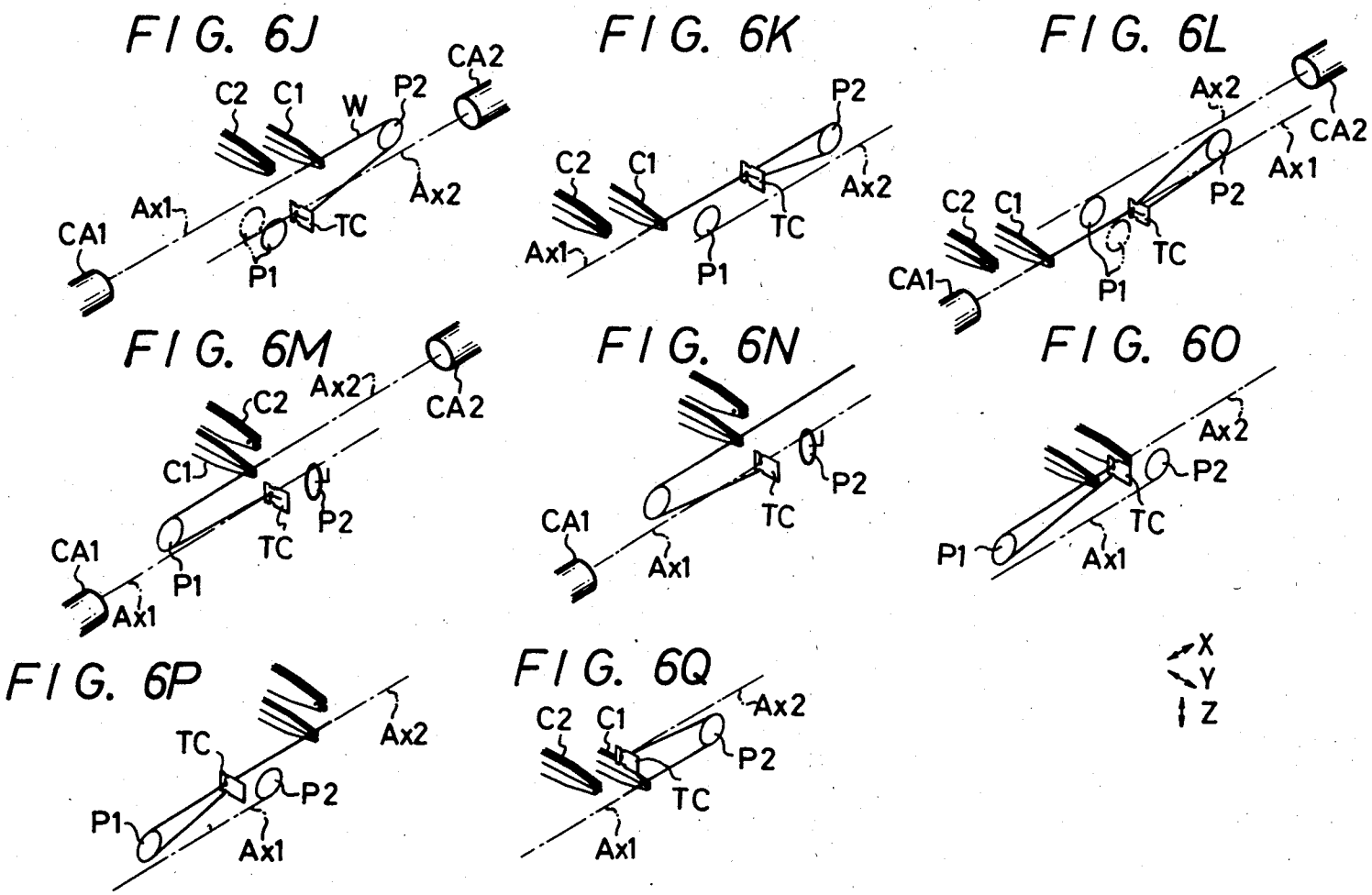

(10) When the winding around the portion A of the toroidal core TC is ended as shown in FIG. 7A, the winding apparatus is in the state as shown in FIG. 6J (this state is the same as the operation initiation state shown in FIG. 6A). Under this state, the free end portion of the wire W is picked up by the first video camera CA1, while the aperture H of the toroidal core TC is picked up by the second video camera CA2. The picking-up operation is the same as the operation described in the paragraph (1) and hence will not be described in detail.

(11) The rotary housing 26 for holding therein the clamps C1 and C2 is moved a little along the X-axis direction to the side of the second video camera CA2. Then, the toroidal core TC is moved upwards along the Z-axis direction and also moved in the Y-axis direction so that the position of the aperture H coincides with the position of the free end portion of the wire W. Next, the second clamp C2 is moved forward so as to place its guide aperture on the optical axis Ax1. By the perfectly same operation as that mentioned in the preceding paragraph (3), under the condition of being held by the first clamp C1, the wire W is inserted through the aperture H of the toroidal core TC and the guide aperture of the second clamp C2 and then gripped by the second clamp C2. Thereafter, the first clamp C1 is opened and moved backward under being such state.

Then, the rotary housing 26 for holding therein the clamps C1 and C2 is moved by a predetermined distance along the X-axis direction to the side of the first camera CA1. Thus, the wire W held by the second clamp C2 is pulled to the side of the first camera CA1 so as to bring its free end portion to a predetermined position. Thereafter, the first clamp C1 is moved forward and then holds the free end portion of the wire W. Subsequently, the second clamp C2 is opened and moved a little to the side of the first video camera CA1, thereby releasing the wire W from the second clamp C2. Thereafter, the clamp C2 is moved backward, and FIG. 6K shows that state.

(12) The first pulley P1 is moved in the lower right-hand side in FIG. 6 along the Y-axis direction, or moved backward and the first video camera CA1 is moved along the Z-axis direction to the underside, thereby lowering the optical axis Ax1 of the first video camera CA1 to the position of the optical axis Ax2 of the second video camera CA2. At the same time, the second video camera CA2 is moved upwards along the Z-axis direction so that its optical axis Ax2 occupies the same position as that of the original optical axis Ax1 of the first video camera CA1. In other words, the optical axes Ax1 and Ax2 are exchanged with each other.

Then, the first pulley P1 is moved along the Y-axis direction to the position of the optical axis Ax1 and also moved upwards along the Z-axis direction to the position contact with the optical axis Ax2. On the other hand, the second pulley P2 is moved downwards along the Z-axis direction from the position of contacting with the optical axis Ax2 to the position of contacting with the optical axis Ax1. Furthermore, the toroidal core TC is lowered from the optical axis Ax2 and positioned on the optical axis Ax1, while the rotary housing 26 for holding therein the clamps C1 and C2 is lowered so as to change the position of the center of the rotation thereof from the height of the optical axis Ax2 to the height of the optical axis Ax1.

Thereafter, the first pulley P1 is moved forward along the Y-axis direction and positioned so as to contact with the optical axis Ax2. FIG. 6L shows that state.

(13) The rotary housing 26 is moved upwards along the X-axis direction so that the height of the center of the rotation of the rotary housing 26 changes from the height of the optical axis Ax1 to that of the optical axis Ax2. Thereafter, the rotary housing 26 is rotated 180° in the clockwise direction, thereby winding the wire W held by the first clamp C1 around the first pulley P1. The first pulley P1 is then moved to the side of the first video camera CA1 to apply a predetermined tension to the wire W. At that time, the free end portion of the wire W held by the first clamp C1 is disposed at the position of the focal point of the second video camera CA2 or the position relatively near thereto.

The free end portion of the wire W is picked up by the second video camera CA2, and FIG. 6M shows that state.

(14) Then, the toroidal core TC is rotated 180° in the counter-clockwise direction. Thereafter, as shown in FIGS. 6N to 6Q, the winding is carried out by the similar operations to those mentioned in the paragraphs (1) to (10) so that the wire is wound around the portion B as shown in FIG. 7B. The rotation direction of the rotary housing 26 in this process becomes opposite to those mentioned in the pagagraphs (1) to (10), namely, clockwise direction.

Figure 9:
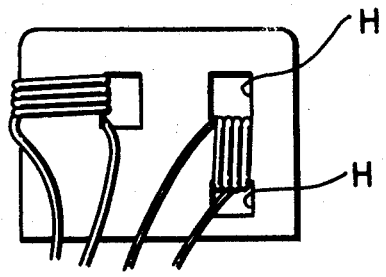
FIG. 9 is a plan view showing toroidal coils having a toroidal core around which wires are wound in the longitudinal direction.
Figure 8A:
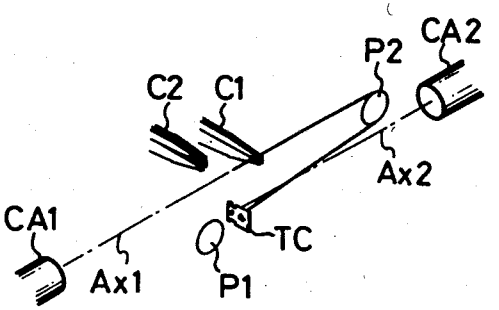
FIGS. 8A to 8F are respectively perspective views showing the change of the main part in another example of operation of the winding apparatus in the correct order of operation.
Figure 8B:
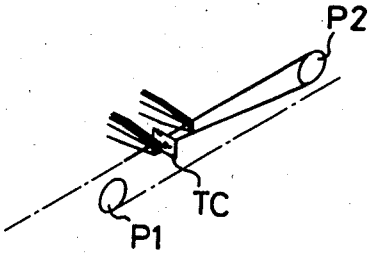
Figure 8C:
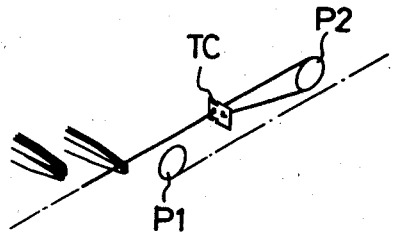
Figure 8D:
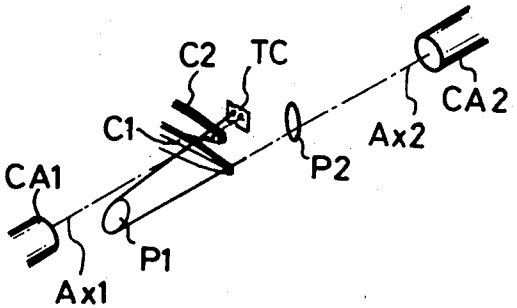
Figure 8E:
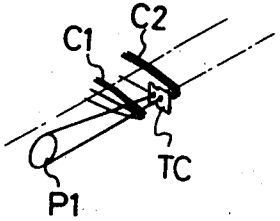
Figure 8F:
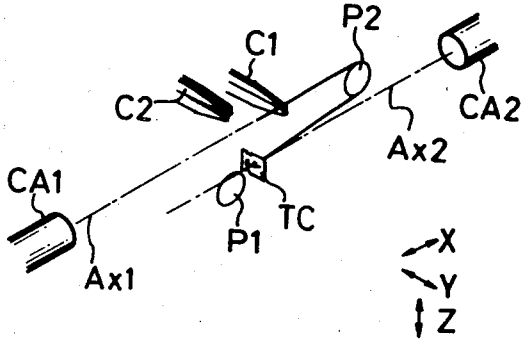

A case in which the wire is wound in the longitudinal direction will be described with reference to FIG. 8. In other words, a case in which the wire is wound around the portion between the apertures H spaced apart on the toroidal core TC in the Y-axis direction as shown in FIG. 9 will be described. As mentioned before, the wire W can be inserted into the aperture H of the toroidal core TC from any one of the sides. Accordingly, as shown in FIGS. 8A to 8F, the longitudinal winding can be carried out by repeating the operation in which under the condition that the toroidal core TC is still, the wire W is inserted into one aperture H from one side of the toroidal core TC, while the free end portion of the wire W inserted into the one aperture H is inserted into the other aperture H from the other side of the toroidal core TC.

As described above, when the longitudinal winding is carried out, the operation shown in FIG. 8 is different from that of the horizontal winding shown in FIG. 6 only in that the toroidal core TC is kept in the stationary state but only the rotary housing 26 is rotated by 180° each and that the two apertures H, H are alternately picked up by the video camera to thereby detect the position. In other aspects, the operations are the same as those mentioned in the paragraphs (1) to (10) and hence will not be described in detail.

Therefore, according to such winding apparatus, the horizontal winding as shown in FIG. 6 and the longitudinal winding as shown in FIG. 8 can freely be carried out.

While in the illustrated winding apparatus the Z-axis direction is taken as the vertical direction and the X-axis and Y-axis directions as the horizontal direction, the X-axis direction, for example, can be taken as the vertical direction and the Z-axis and the Y-axis directions as the horizontal direction. In this case, two video cameras are disposed in the upper and lower sides of the toroidal core which is supported vertically and the pulleys are disposed between the video cameras and the toroidal core.

While in the illustrated winding apparatus the rotary housing is moved in the Z-axis direction and the X-axis direction, it is not always necessary that the rotary housing can be moved in both of the Z-axis direction and the X-axis direction but the rotary housing may be moved only in the X-axis direction with its center of rotation being placed at the middle position between the two optical axes Ax1 and Ax2.

A control apparatus for controlling the winding apparatus will be described. FIGS. 10 to 13 are respectively diagrams useful for explaining the control apparatus.

Figure 10:
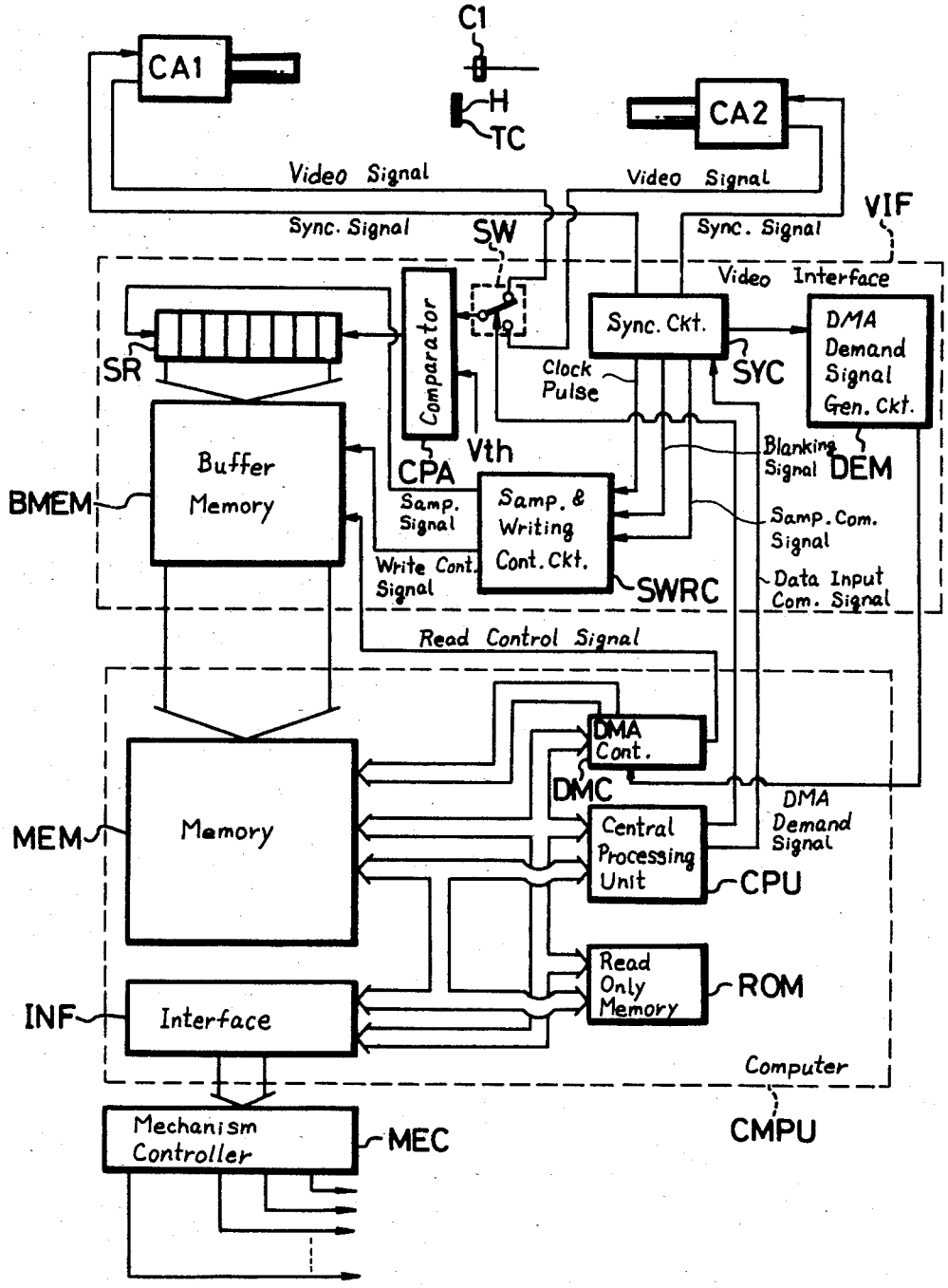
FIG. 10 is a block diagram showing a circuit arrangement of a control apparatus used in the winding apparatus of the present invention.

FIG. 10 is a block diagram showing a circuit arrangement of the control apparatus. In FIG. 10, reference character VIF designates a video interface by which video signals from the first and second video cameras CA1 and CA2 are processed, temporarily stored and properly sent to a computer CMPU. Also the video interface VIF functions to send synchronizing signals to the video cameras CA1 and CA2 so as to carry out the horizontal and vertical scannings. Reference character SYC designates a synchronizing circuit for generating the synchronizing signals which are supplied to the video cameras CA1 and CA2. This synchronizing circuit SYC incorporates an oscillator having an oscillation frequency of 14.31818 MHz and produces a horizontal synchronizing signal with a frequency of about 15.7 kHz which comes from frequency-dividing the oscillation signal of the oscillator into a signal with frequency 1/910 of the frequency of the oscillation signal. This horizontal synchronizing signal is supplied to the first and second video cameras CA1 and CA2. Also, the synchronizing circuit SYC functions to produce a clock pulse for forming a sampling signal with frequency of 2.86 MHz by frequency-dividing the oscillation signal to 1/5 and to supply the same to an 8-bit shift register SR through a sampling and writing control circuit SWRC which will be described later.

Reference character DEM designates a DMA demand signal generating circuit which supplies a DMA demand signal to a DMA controller DMC of the computer CMPU and which generates the DMA demand signal of one pulse during every two horizontal periods in response to the horizontal synchronizing signal from the synchronizing circuit SYC.

Reference character SW designates a switching circuit which is supplied with the video signals from the first and second video cameras CA1 and CA2 so as to supply to a comparator CPA the video signal derived from the video camera corresponding to a camera selecting signal which is supplied from a central processing unit CPU of the computer CMPU.

The comparator CPA compares the video signal supplied from the video camera CA1 or CA2 through the switching circuit SW with a reference voltage (threshold voltage Vth) which then is formed into a binary-coded signal. The binary-coded signal from the comparator CPA is supplied to the 8-bit shift register SR. The shift register SR is controlled by the sampling signal from the sampling and writing control circuit SWRC to sample the output signal from the comparator CPA and to shift the same.

Figure 11:
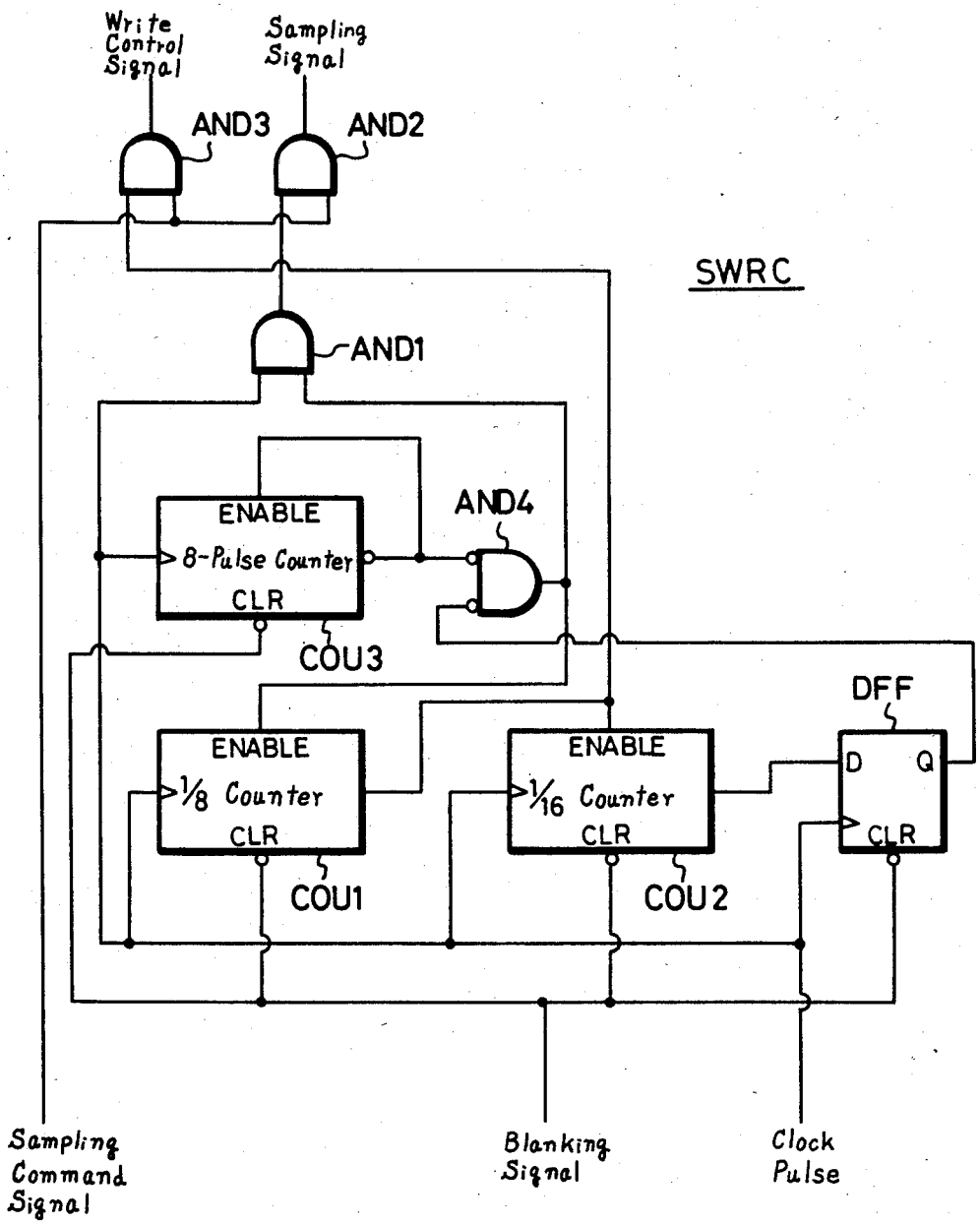
FIG. 11 is a circuit diagram of a sampling and writing control circuit used in the present invention.

Reference BMEM designates a buffer memory for storing a binary coded video signal of one horizontal scanning amount and which has a storage capacity of $8\times16$ bits. The buffer memory BMEM latches in parallel the video signal of 8 bits stored in the shift register SR, and the buffer memory BMEM latches this video signal 16 times at each horizontal scanning period. After the latching of the video signal within one horizontal scanning period is ended, the video signal of 8 bits is parallelly sent 16 times from the buffer memory BMEM to the computer CMPU during the next horizontal scanning period. As described above, the binary coded video signal of one horizontal scanning amount is sent during two horizontal scanning periods. This buffer memory BMEM is controlled by the write control signal from the sampling and writing control circuit SWRC. FIG. 11 is a diagram showing a circuit arrangement of the sampling and writing control circuit SWRC. In FIG. 11, reference characters AND 1 to AND 4 respectively designate AND circuits. The first AND circuit AND 1 is supplied at its one input terminal with the clock pulse from the synchronizing circuit SYC and the output signal thereof is supplied to one input terminal of the second AND circuit AND 2. The second AND circuit AND 2 is supplied at the other input terminal with a sampling command signal and the output signal thereof is supplied to the shift register SR as the sampling signal. The third AND circuit AND 3 is supplied at its one input terminal with the sampling command signal and at the other input terminal with the output signal from a first counter COU 1 which will be described below.

The first counter COU 1 generates an output signal of one pulse each time it counts the clock pulse 8 times. The output signal therefrom is supplied to a second counter COU 2, which will be described below, as an enable signal and to the third AND circuit AND 3 as mentioned before. The first counter COU 1 is supplied with an enable signal through the fourth AND circuit AND 4 from a third counter COU 3 which will be described later and cleared up when it is supplied with a blanking signal.

The second counter COU 2 produces the signal of one pulse each time it counts the pulse of the input signal 16 times, and supplied with the clock pulse as its input signal. In this case, the second counter COU 2 receives the output signal of the first counter COU 1 as the enable signal as mentioned before so that after the first counter COU 1 was supplied with the enable signal and the second counter COU 2 counts the clock pulse 128 times, it substantially produces the output signal. Reference character DFF designates a D-type flip-flop circuit which receives the output signal of the second counter COU 2 as its input signal. The D-type flip-flop circuit DFF is supplied at its clock pulse input terminal with the clock pulse from the synchronizing circuit SYC. The output signal Q of the D-type flip-flop circuit DFF is supplied to one input terminal of the fourth AND circuit AND 4. The fourth AND circuit AND 4 receives two input signals being respectively inverted state and produces logical multiplication so that serves substantially as a NOR circuit. The fourth AND circuit AND 4 is supplied at the other input terminal with the output signal from the third counter COU 3. The output signal thereof is supplied to the other input terminal of the first AND circuit AND 1 and also to the first counter COU 1 as the enable signal as mentioned before. The third counter COU 3 produces one pulse of the output signal "L" (low level) when it counts 8 clock pulses. The third counter COU 3 receives its output signal as the enable signal therefor and brought into stop mode when the enable signal is at "L" level.

Similarly to the first counter COU 1, the second and third counters COU 2 and COU 3 and the D-type flip-flop circuit DFF are cleared by the blanking signal of "L" level.

The computer CMPU will be described next. Turning back to FIG. 10, reference character CPU designates the central processing unit, ROM a read-only memory, DMC a DMA controller, MEM a random access memory for storing the video signal derived from the buffer memory BMEM of the video interface VIF and temporarily storing intermediate data produced in the course of calculation process and INF an interface which produces various mechanism control signals generated by the calculation process in the computer CMPU.

The control signal derived from the interface circuit INF of the computer CMPU is supplied to a mechanism controller MEC. Then, the mechanism controller MEC controls respective sections of the mechanism sections of the winding apparatus on the basis of the mechanism control signal.

Figure 12:
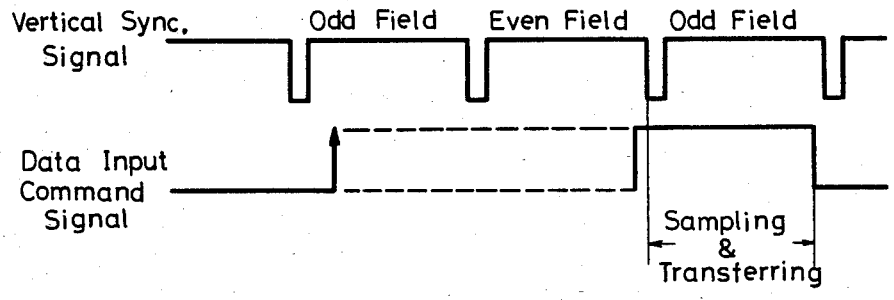
FIG. 12 is a timing chart showing a horizontal synchronizing signal, a sampling signal and a DMA demand signal.
Figure 13:
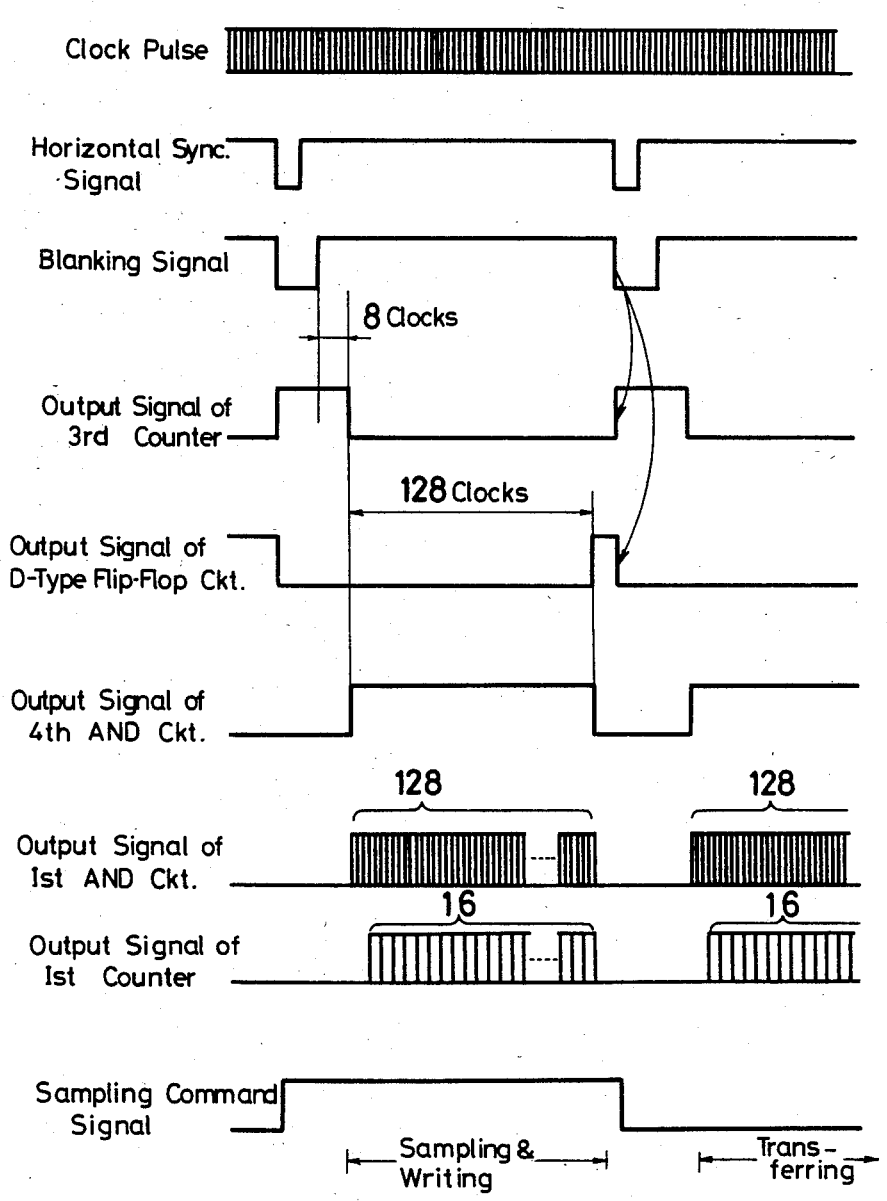
FIG. 13 is a timing chart useful for explaining the operation of the sampling and writing control circuit.

The operation of the control apparatus in which the video signal is supplied through the video interface circuit VIF, processed by the computer CMPU and then stored in the buffer memory BMEM will be described with reference to FIGS. 12 and 13.

When the free end surface of the wire W or the aperture H of the toroidal core TC is picked up by the video camera CA1 or CA2, a data input command signal is sent from the central processing unit CPU of the computer CMPU to the synchronizing circuit SYC. Then, as shown in FIG. 12, when a first vertical synchronizing signal for carrying out the vertical scanning of the odd field after the data input command signal was sent is produced, during the vertical scanning period of the following odd field, the video signal is sampled and transferred from the video interface VIF to the memory MEM of the computer CMPU. When the transfer of the video signal (binary coded video signal of 128×128 bits) of one picture screen is ended, the central processing unit CPU stops sending the data input command signal.

By the way, the data input command signal is sent from the central processing unit CPU and a camera selecting signal for designating which one of the video cameras CA1 and CA2 is selected is supplied to the switching circuit SW from the central processing unit CPU so that the video signal produced from the video camera selected by the camera selecting signal is inputted to the comparator CPA. The video signal inputted to the comparator CPA is compared with the reference voltage Vth and formed into a binary coded signal. The binary coded video signal is sampled by the shift register SR and its sampling pulse is produced from the sampling and writing control circuit SWRC shown in FIG. 11.

The operation of the sampling and writing control circuit SWRC will be described with reference to a timing chart of FIG. 13. The sampling and writing control circuit SWRC is supplied with the clock pulse, the blanking signal and the sample command signal from the synchronizing circuit SYC. The clock pulse has the frequency of 2.86 MHz and used as the sampling signal as mentioned before. The blanking signal is produced in synchronism with the horizontal synchronizing signal, and during a period in which the blanking signal is at "H" (high) level, the video signal is used effectively. This blanking signal is used in the sample and writing control circuit SWRC to clear the counters COU 1 to COU 3 and the D-type flip-flop circuit DFF. In other words, at the same time when the horizontal synchronizing signal comes (falls down), the blanking signal comes (falls down) so that each of the above circuits is cleared. This state is continued until the blanking signal disappears (rises up). When the blanking signal rises up with a small delay time from the rising-up of the horizontal synchronizing signal, the third counter COU 3 starts counting the clock pulse. Although the first and second counters COU 1 and COU 2 are released from the cleared state, they do not yet receive the enable signal so that they do not yet start counting the clock pulse.

When the third counter COU 3 counts 8 clock pulses, the level of the output signal thereof is inverted from "H" to "L" and the level of the output signal from the fourth AND circuit AND 4 is inverted from "L" to "H". As a result, the first AND circuit AND 1 produces the clock pulse as it is which is supplied to one input terminal thereof. The sample command signal is arranged so as to invert its content each time the horizontal synchronizing signal is received so that when it becomes "H" level during, for example, the first horizontal scanning period, it becomes "L" level during the next horizontal scanning period. Accordingly, during the odd horizontal scanning period, the clock pulse derived from the first AND circuit AND 1 is directly supplied through the second AND circuit AND 2 to the shift register SR as the sampling signal. During even horizontal scanning period, the second AND circuit AND 2 produces no clock pulse so that the shift register SR does not perform the sampling operation. During this even horizontal scanning period, the video signal stored in the buffer memory BMEM is transferred to the memory MEM within the computer CMPU.

As described above, when the third counter COU 3 counts 8 clock pulses after the blanking signal rose up, the output signal from the fourth AND circuit AND 4 becomes "H" level so that the first counter COU 1 receives the enable signal and starts the counting of the clock pulse. Then, the first counter COU 1 generates the output signal of one pulse each time it counts 8 clock pulses. The output therefrom is supplied through the third AND circuit AND 3 to the buffer memory BMEM as its writing control signal (only when the sampling command signal is being produced). When the buffer memory BMEM receives the writing control signal, this buffer memory BMEM stores the signal of 8 bits which is recorded in the shift register SR.

When such operation that such sampling operation is carried out 8 times, one writing operation is carried out is performed 16 times, the second counter COU 2 generates the output signal and this output signal is supplied to the D-type flip-flop circuit DFF. In other words, although the second counter COU 2 is supplied at its input terminal with the clock pulse, the second counter COU 2 is enabled only when the first counter COU 1 produces the output signal so that it does not count one pulse until the number of clock pulses supplied to the input terminal becomes eight. Then, since the second counter COU 2 produces the output signal by carrying out the counting operation 16 times, it substantially functions as a counter which counts 128 clock pulses. Consequently, when the operation that when the sampling is carried out 8 times, the writing is carried out once is carried out 16 times, the second counter COU 2 produces the output signal. When the output signal of the counter COU 2 is produced, the D-type flip-flop circuit DFF produces an output signal on the basis of such signal. This output signal is supplied to the fourth AND circuit AND 4 so that the level of the output signal from the fourth AND circuit AND 4 is inverted from "H" to "L". As a result, the clock pulse inputted to the first AND circuit AND 1 is inhibited from being delivered from the first AND circuit AND 1 so that no sampling signal is supplied to the shift register SR.

Thereafter, when the odd horizontal scanning period is ended and the following horizontal synchronizing signal is produced, the blanking signal is produced at the same time so that the first to third counters COU 1 to COU 3 and the D-type flip-flop circuit DFF are all cleared by such blanking signal and returned to the original mode. In consequence, although during the following even horizontal scanning period each circuit in the sampling and writing control circuit SWRC except the second and third AND circuits AND 2 and AND 3 carries out the same operation as that in the above odd horizontal scanning period, since the sample command signal inputted to one input terminal of each of the second and third AND circuits AND 2 and AND 3 is "L" in level, neither of the sampling signal and the writing control signal are generated, thereby carrying out neither the sampling nor the writing operation. The operation which will be carried out during the even horizontal scanning period is to transfer the signal, which is sampled during the odd horizontal scanning period and written in the buffer memory BMEM, to the memory MEM of the computer CMPU. The transfer of the signal from the buffer memory BMEM to the memory MEM of the computer CMPU is carried out by direct memory access which does not pass through the central processing unit CPU but directly accesses the memory MEM. The direct memory access is carried out under the control of the DMA controller DMC. More particularly, when the horizontal scanning period in which the even horizontal scanning is carried out appears, in correspondence therewith the DMA demand signal is sent from the DMA demand signal generating circuit DEM to the DMA controller DMC. Receiving the DMA demand signal, the DMA controller DMC supplies the read control signal to the buffer memory BMEM and the write control signal to the memory MEM, thereby transferring the video signal of $8\times16$ bits of one horizontal scanning amount stored in the buffer memory BMEM to the memory MEM.

When the even horizontal scanning begins as mentioned before, the DMA demand signal is sent from the DMA demand signal generating circuit DEM to the DMA controller DMC (see FIG. 12) so that under the control of the DMA controller DMC, the video signal of $16\times8$ bits is transferred to the memory MEM of the computer CMPU in the form of, for example, parallel data of 8 bits each.

When the above sampling and transferring operations are alternately carried out 128 times during one vertical scanning period of the odd field, a binary coded video signal ($128\times128$ bits) of one picture amount is written in the memory MEM.

As described above, in this embodiment, the computer CMPU incorporating therein the DMA controller DMC which can directly access the memory MEM from the outside is used to carry out the video signal processing and the video interface VIF incorporating therein the buffer memory BMEM which can store the video signal of one horizontal scanning amount is interposed between the video cameras CA1, CA2 and the computer CMPU. The reason for this is as follows. The reason why the computer CMPU which can carry out the direct memory access is used is to make necessary data be written in the memory MEM of the computer CMPU from the outside without a memory of large storage capacity being provided in the outside. However, the write (readout) timing for the direct memory access is determined by the characteristics of the DMA controller DMC, and is not coincident with a timing at which the video camera produces the video signal. Therefore, the video interface VIF incorporating therein the buffer memory BMEM capable of storing the video signal of one horizontal scanning amount is provided to perform the sampling at the timing of the video camera side during one horizontal scanning period (in this embodiment, odd horizontal scanning period of odd field) and to perform the writing in the memory MEM at the timing of the DMA controller DMC during the next horizontal scanning period. Thus, the buffer memory BMEM provided in the video interface VIF may have a storage capacity of storing the video signal of one horizontal scanning amount, so it becomes unnecessary to use a memory of a large storage capacity.

The computer CMPU carries out along a predetermined program various kinds of controls necessary for operating normally the winding apparatus in addition to the controls for processing the binary coded video signal stored in the memory MEM, for detecting the positional relation between the aperture H of the toroidal core TC and the free end portion of the wire W and for controlling the clamp driving mechanism and the core driving mechanism in accordance with the detected results so as to match the position of the aperture H with that of the wire W. Moreover, the various control signals are sent from the interface circuit INF to the respective pulse motors and so on through the mechanism controller MEC provided outside the computer CMPU.

Further in this embodiment, the video interface VIF and the computer CMPU are provided for two video cameras CA1 and CA2, and the switching circuit SW which is controlled by the camera selecting signal derived from the computer CMPU is provided in the video interface VIF to properly select either of the video signals from the two video cameras CA1 and CA2 for processing the same. In this case, it is also possible that two pairs of the video interfaces VIF and the computers CMPU are provided corresponding to two video cameras to process the video signal from each video camera CA in each pair of the video interface VIF and the computer CMPU.

By the way, when the binary coded video signal from the video camera is processed to match the positional relation between the aperture H of the toroidal core TC with that of the free end portion of the wire W, it becomes necessary to detect the position of the aperture H and that of the free end portion of the wire W. In this case, when detecting the position, it becomes a serious problem to recognize which part of the aperture H will be the exact position of the aperture H. Because, the wire W is extremely thin and generally circular in cross-section so that the center point of the free end surface of the wire W may be recognized as the position of the wire W. However, the aperture H is expanded and at first the shape thereof is simple such as a square. However, its shape changes to a complicated form as the winding process advances so that optimum position of the aperture H into which the wire W is inserted changes incessantly. Unless the optimum position of the aperture H into which the wire W is inserted is recognized as the position of the aperture H so as to control the positioning, a quite small positioning error based on the limit in the accuracy of the winding apparatus causes the wire W to be positioned at the position a little displaced from the aperture H. There is then some fear that the wire W can not be inserted into the aperture H of the toroidal core TC. Therefore, the optimum position of the aperture H into which the wire W is inserted must be detected and recognized as the position of the aperture H.

FIGS. 14 to 22 are respectively diagrams useful for explaining a method of detecting the wire insertion position of the aperture H, and the method of detecting the wire insertion position of the aperture H according to this embodiment will be described with reference to FIGS. 14 to 22.

Figures 14A, 14B, 14C:
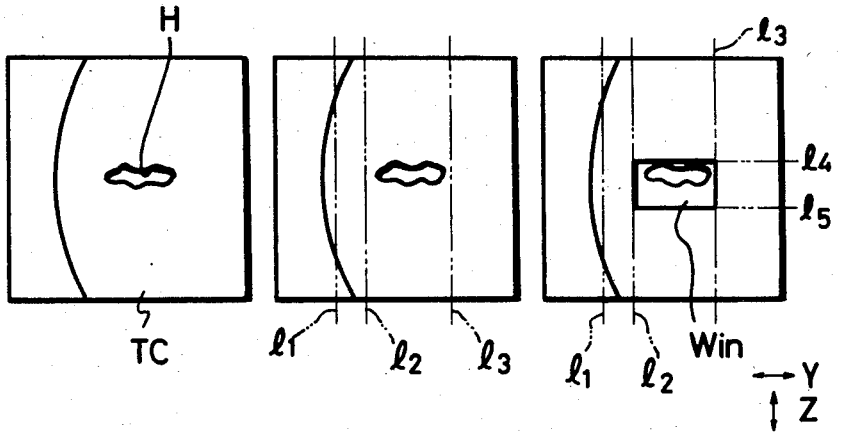
FIGS. 14A, 14B and 14C are respectively diagrams of picture image data useful for explaining a process in which a front edge of a toroidal core and its aperture are detected and a window is determined.

From the picture image data of 128×128 bits representing the nearby portion of the aperture H of the toroidal core TC and stored in the memory MEM of the computer CMPU, a processing area for processing a picture image, namely, a window is set. FIGS. 14A, 14B and 14C are respectively diagrams useful for explaining a method of setting a window Win. FIG. 14A shows an example of the picture image data made of a binary coded video signal (128×128 bits) in which the portion of the toroidal core TC is represented as "0" and the portions of background of the toroidal core TC and of its aperture H are represented as "1". In this picture image data, a coordinate (Y-coordinate) of the front edge $l_1$ of the toroidal core TC as shown in FIG. 14B is obtained. Specifically, the search (in association with the description of the mechanism section of the winding apparatus, this search is called Y-axis direction search) is carried out from the left-hand side to the right-hand side in FIG. 14B. Then, the calculation for obtaining the Y-coordinate of "1" which appears first is carried out for each line in the Y-axis direction and its mean value is presented as the coordinate of the front edge $l_1$.

Then, line $l_2$ in the Z-axis direction positioned backward (the right-hand side in FIG. 14) from the front edge $l_1$ by, for example, 8 bits and line $l_3$ in the Z-axis direction positioned backward from the line $l_2$ by 40 bits are respectively calculated. Then, as shown in FIG. 14C, in the area surrounded by the lines $l_2$ and $l_3$, the Y-axis direction search operation is carried out for each line in the Y-axis direction in the order of top to bottom. In this search, it is normal that "0" is detected first. Thereafter, when the position of the aperture H is detected, "1" is detected. Therefore, when "1" is continued for a predetermined bit number or above after "0" was detected for a predetermined bit number or above, "1" which was detected first is recognized as the existence of the aperture H. A line $l_4$ in the Y-axis direction passing through that portion is calculated and further that a line $l_5$ in the Y-axis direction, which is positioned in the lower side by 25 bits from the line $l_4$ is calculated. Then, the area surrounded by the lines $l_2$, $l_3$, $l_4$ and $l_5$ is recognized as the window Win and data within this area is taken as an object for the picture image processing. As described above, the picture image processing object is limited, the signal processing time can be reduced.

When the toroidal core TC is not held by the core driving mechanism 1 by its holding error or the position at which the toroidal core TC is held by the core driving mechanism 1 is displaced greatly so that the front edge of the toroidal core TC is not located within the visual field of the video camera CA and the front edge $l_1$ can not be detected and accordingly when the aperture H can not be detected, a warning for indicating the occurrence of trouble is made and the operation of the mechanism section of the winding apparatus is automatically stopped.

Figures 15A, 15B, 15C:
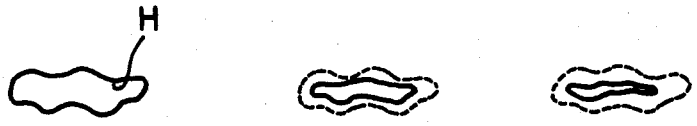
FIGS. 15A to 15E are respectively diagrams useful for explaining a principle under which the aperture of core on the picture image data is shrinked so as to detect a wire insertion position.
Figures 15D, 15E:
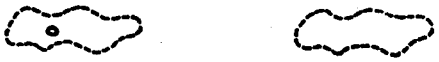

When the setting of the window Win is ended, the optimum wire insertion position of the aperture H is detected. FIGS. 15A to 15E are respectively diagrams useful for explaining a fundamental principle of its detecting method. In this detecting method, the wire insertion position is selected from an area in which the aperture H still remaines as shown in FIG. 15D which is just before the aperture H is completely fulfilled by the wire as shown in FIG. 15E from the aperture H having a shape as shown in FIG. 15A from which the aperture H has been shrinked little by little from its periphery. According to such detecting method, regardless of the shape of the aperture H, a point relatively distant from the periphery of the aperture H which is suitable for passing therethrough the wire W can be recognized as the wire insertion position. Alternatively, when the aperture H is divided by the wires W as shown in FIG. 16A, its picture image data becomes as shown in FIG. 16B in which two apertures H appear. Also in this case, when the apertures H are shrinked, the smaller aperture H is first lost and a point distant from the periphery of the larger aperture H is detected as the wire insertion position. Thus there is no fear that the position of the wire W dividing the aperture H is detected as the wire insertion position.

Figure 18A:
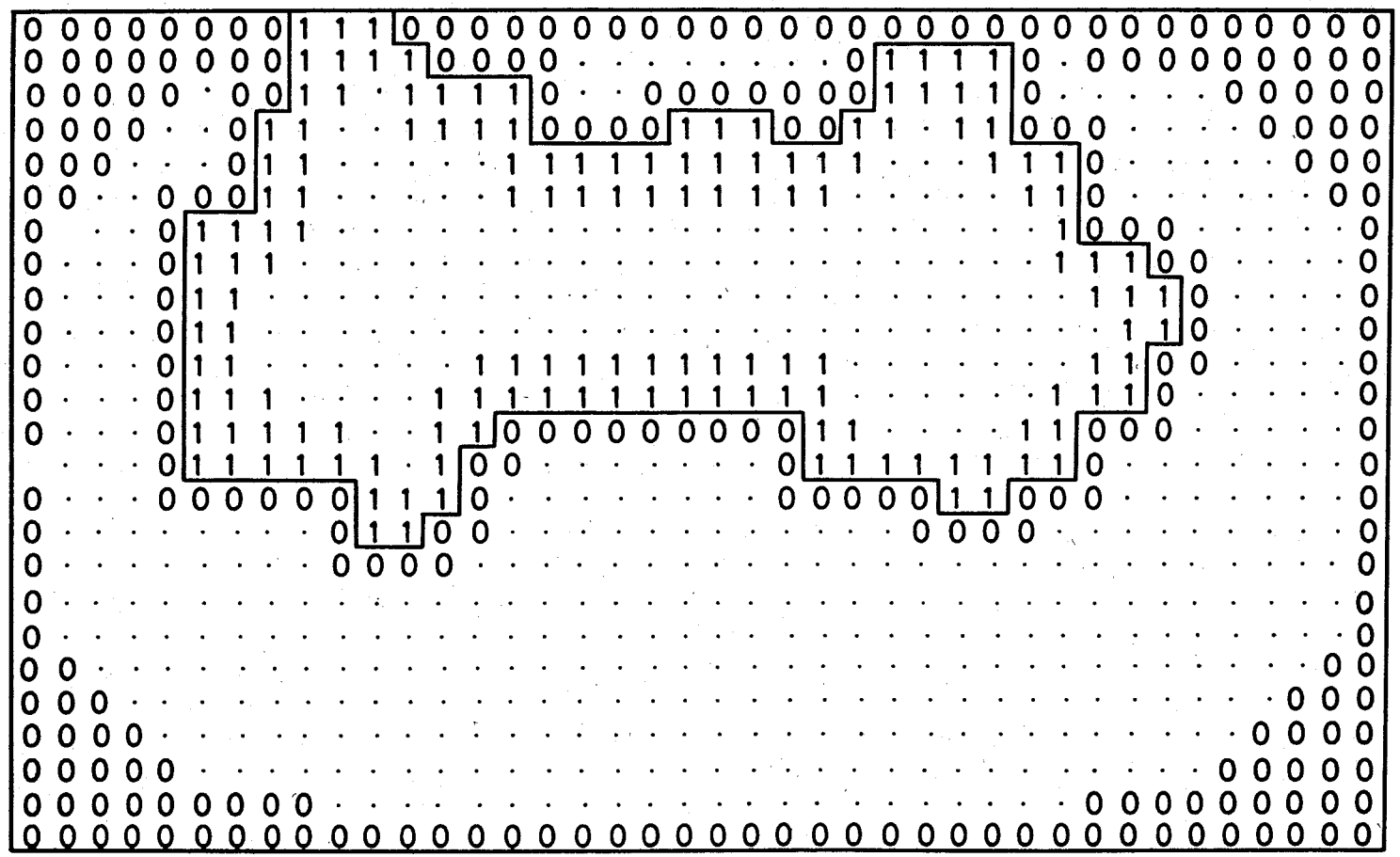
FIGS. 18A to 18D are respectively diagrams of picture image data showing the change of the picture image data when the processing for shrinking the aperture of core is carried out.
Figure 18B:
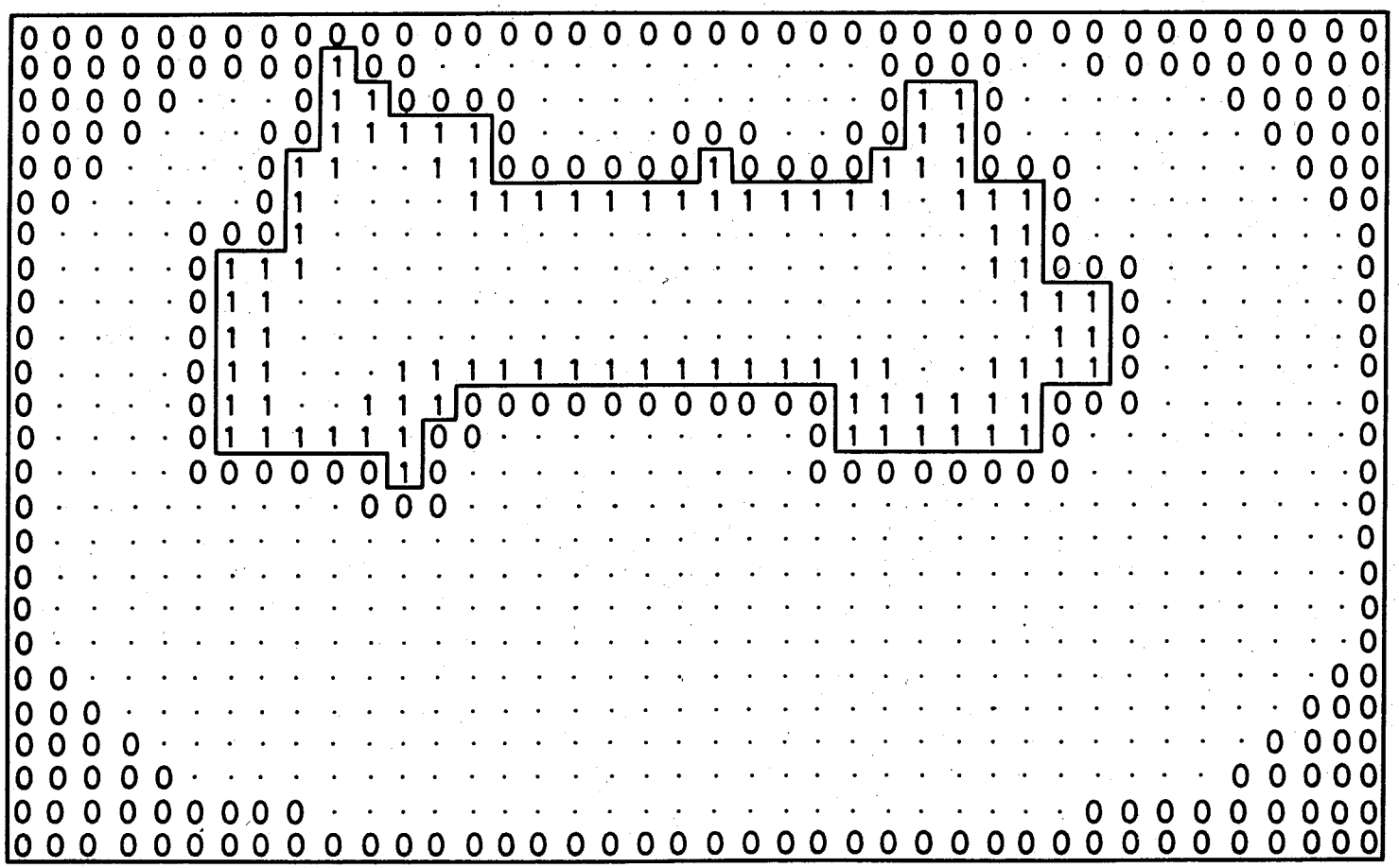
Figure 18C:
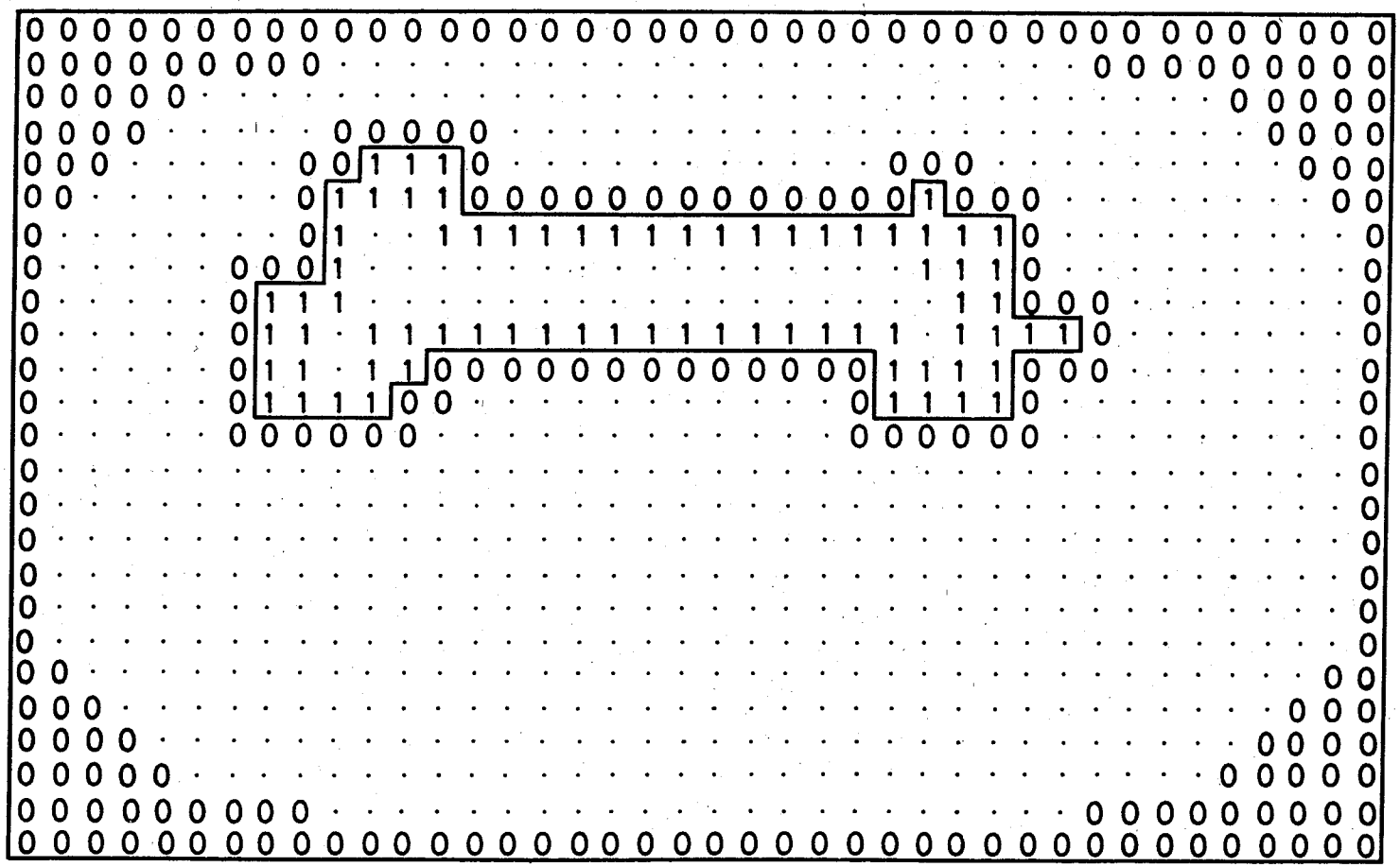
Figure 18D:
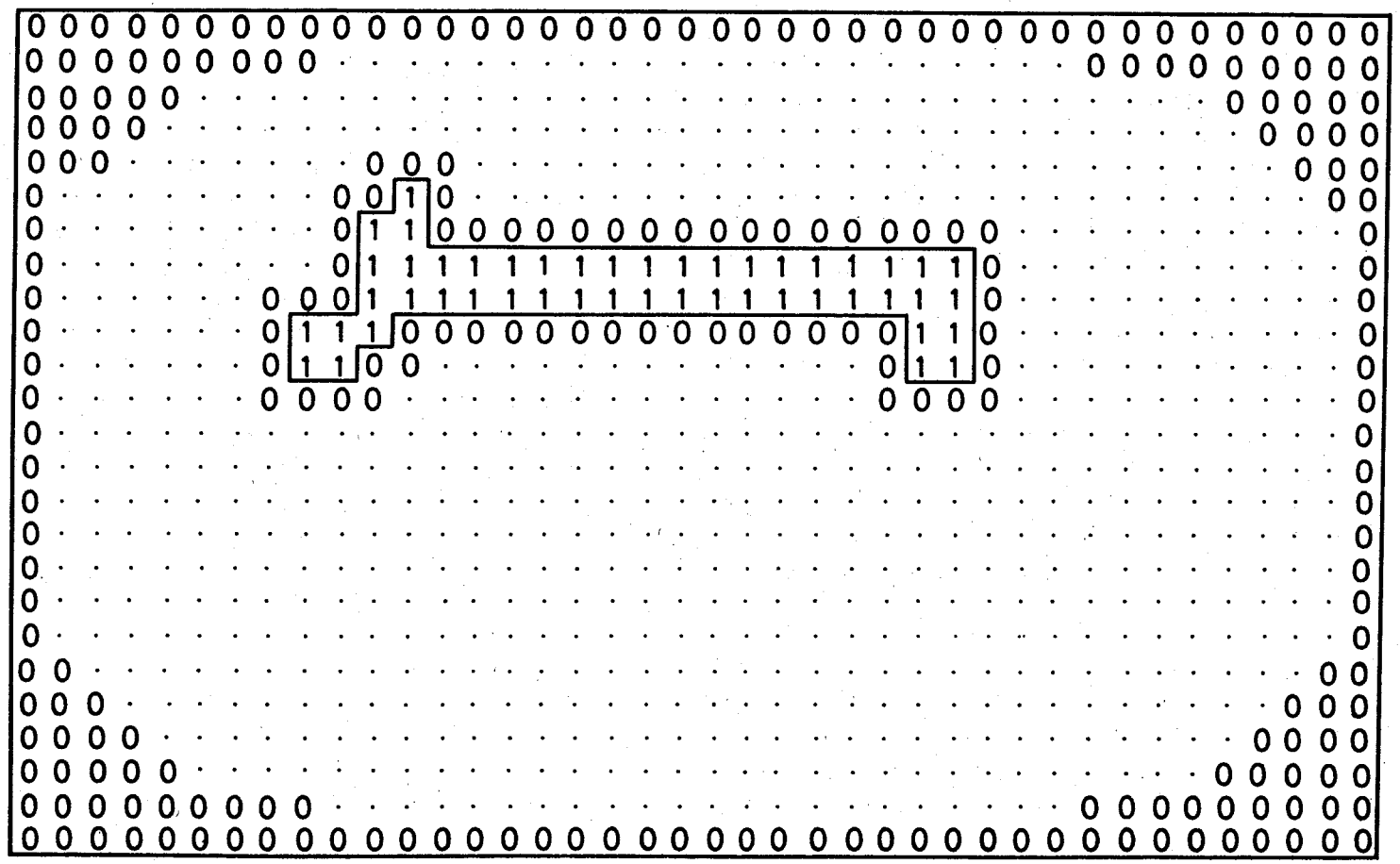

FIGS. 17A to 17E are respectively diagrams useful for explaining a method of shrinking the aperture H on the data. When the aperture H on the picture image data is gradually shrinked, the logical multiplication of 9 picture elements consisting of one center picture element P and 8 picture elements Q surrounding the center picture element P as shown in FIG. 17A is calculated. When as shown in FIG. 17B any one of 9 picture elements is "0", or when the logical multiplication thereof becomes "0", the center picture element P is made as "0" as shown in FIG. 17C. When 9 picture elements are all "1"s as shown in FIG. 17D, or when the logical multiplication thereof is "1", the center picture element P is left as "1" as shown in FIG. 17E. Such processing is carried out within the whole area of the window Win with the center picture element being changed in turn. FIGS. 18A to 18D are respectively diagrams showing the change of picture image data in one case in which the aperture H is gradually shrinked. FIG. 18A shows picture image data before being shrinked, FIG. 18B shows the picture image data which is shrinked once, FIG. 18C shows the picture image data which is shrinked twice and FIG. 18D shows the picture image data which is shrinked three times. In this example, if the picture image is shrinked four times, the aperture H is lost. FIG. 18D shows the picture image data just before the aperture H is lost by the shrinking process.

Figure 19:
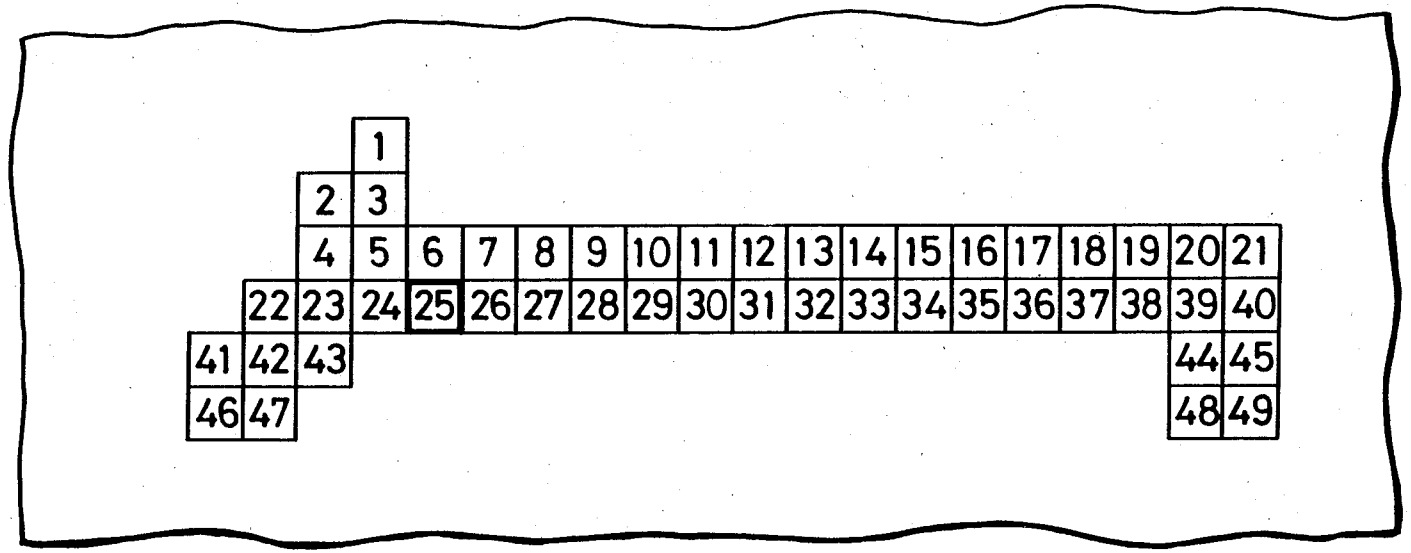
FIG. 19 is a diagram useful for explaining a first embodiment of an optimum point selecting method according to the present invention.

The wire insertion position is selected from the bits representing the aperture H of the picture image data in the step just before the aperture H is lost by the shrinking process as shown in FIG. 18D. FIG. 19 shows an example of an optimum point selecting method in which one bit is selected from the bits remaining after the shrinking process as the optimum point. As shown in FIG. 19, the bits representing the aperture H which remain after the picture image data was shrinked are assigned with the numbers from 1 to the numbers corresponding to the bits representing the aperture H. To be more concrete, the numbers are assigned to the bits, for example, in such a manner that a smaller number is assigned to a higher bit while a smaller number is assigned to a left side bit in the same height. Then, the position of the bit of the smallest number (in this embodiment, 25) which exceeds the number resulting from multiplying the number of bits (in this embodiment, 49) of the shrinked aperture H by $\frac{1}{2}$ is recognized as the optimum wire insertion position.

Figure 20:
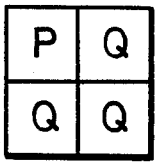
FIG. 20 is a diagram useful for explaining a second embodiment of the optimum point selecting method according to the present invention.

FIG. 20 is a diagram useful for explaining another example of the optimum point selecting method. This method is applied to such a case that when the aperture H is relatively small, the optimum point is selected from the bits representing the aperture H which remain after the picture image data was shrinked. That is, when the aperture H is small, it is necessary to detect the optimum wire insertion position with higher accuracy. However, according to the method in which the logical multiplication output of 9 picture elements consisting of one center picture element P and 8 picture elements Q surrounding the center picture element P, a protrusion or concave portion of a size corresponding to 7 or 8 bits of the aperture H is neglected, so that the detected position does not always become the proper position at which the wire W is inserted into the aperture H. Therefore, for the aperture which is reduced by a small number of shrinkings, as shown in FIG. 20, the logical multiplication of 4 bits of $2\times2$ bits in the square area is calculated. When its logical multiplication is "0", a processing in which a particular bit within the square area, for example, a bit P on the upper left portion of FIG. 20 is made as "0" is carried out in turn.

The number is assigned to the bits representing the aperture H remaining on the picture image data after this processing is ended by the same method as the first optimum point selecting method. As a result, the position of the bit of the smallest number in the numbers exceeding one half the number of remaining bits representing the shrinked aperture H is recognized as the optimum wire insertion position.

By calculating the logical multiplication and reducing the number of the bits, it is possible to detect a more proper position at which the wire W is inserted into the hole H of core with higher accuracy.

Figure 21:
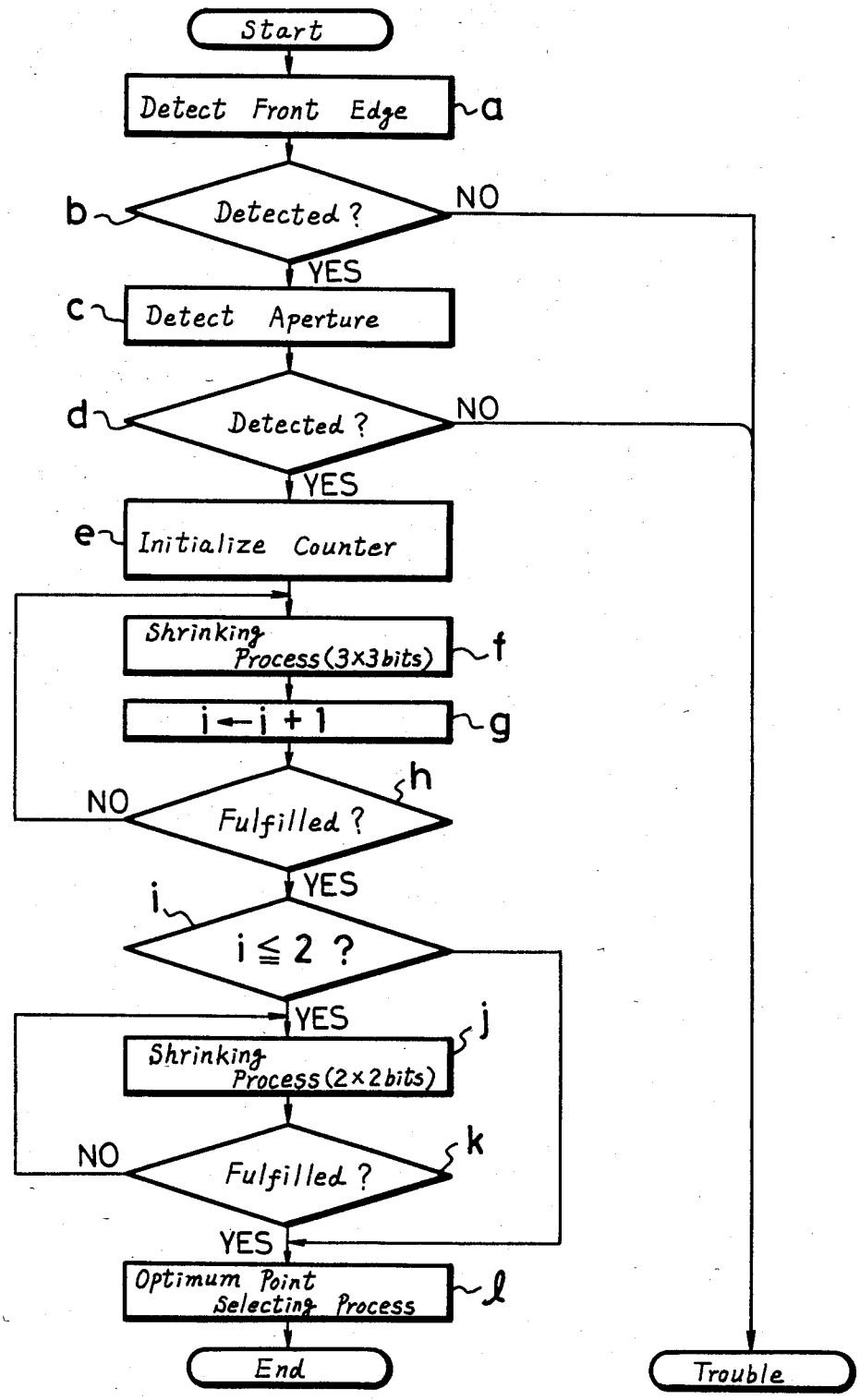
FIG. 21 is a flow chart showing a program by which a wire insertion position is detected.

FIG. 21 shows the flow chart of a program to be executed by the computer CMPU to detect the wire insertion position on the aperture H.

(a) "Detect front edge"

The front edge $l_1$ of the toroidal core TC is detected as shown in FIG. 14B.

(b) "Detected?"

It is judged whether or not the front edge $l_1$ of the toroidal core TC is detected at step (a). When the judged result is "NO", the operation of the mechanism section of the winding apparatus is stopped and a warning for indicating the occurrence of trouble is made.

(c) "Detecting the aperture of the core"

When the judged result of "YES" indicating that the front edge $l_1$ could be detected at step (b) is obtained, the aperture H is detected as shown in FIG. 14C. Then, the window Win is set on the basis of the detected result.

(d) "Detected?"

It is judged whether or not the aperture H could be detected at step (c) for detecting the aperture H. When the judged result is "NO", the operation of the mechanism section of the winding apparatus is stopped and a warning is made so as to indicate the occurrence of trouble.

(e) "Initialize counter"

When the judged result "YES" was obtained at step (d), the counter for counting the number of the following shrinking processes is initialized.

(f) "Shrinking process ($3\times3$ bits)"

The logical multiplication of all bits in the square area formed of $3\times3$ bits is obtained, the bit of the center picture element P is rewritten in accordance with the content of the logical multiplication and the process to shrink the aperture H is carried out.

(g) "i←i+1"

When the shrinking process at step (f) is ended, the content i of the counter is incremented by "1".

(h) "Fulfilled?"

It is judged whether or not the aperture H shrinked at step (f) is completely fulfilled. When the judged result is "NO", this step is returned to the step (f) of "Shrinking process (3×3 bits)".

(i) "i≦2?"

When the judged result of step (h) is "YES", it is judged whether or not the content i of the counter, which counts the numbers for shrinking the aperture H, is less than 2. This process is to judge whether or not the aperture H from which the wire insertion position is detected is small.

(j) "Shrinking process (2×2 bits)"

When the judged result "YES" is obtained at step (i), for the picture image data in the step just before the aperture H is shrinked and fulfilled in the step (f), the logical multiplication of the respective bits within the square area of 2×2 bits as shown in FIG. 20 is obtained and the bit of particular picture element P is rewritten in response to the content of the logical multiplication, thereby shrinking the aperture H. That is, the processing is carried out by the second example of the optimum point selecting method.

(k) "Fulfilled?"

It is judged whether or not the aperture H was fulfilled by the process at step (j). If the judged result is "NO", the step is returned to the step (j) so as to carry out "Shrinking process (2×2 bits)".

(l) "Optimum point selecting process"

When the judged result "NO" is obtained at step (i) or when the judged result "YES" is obtained at step (k), on the basis of the remaining bits indicating the core aperture H, for the picture image data at the step just before the aperture H is fulfilled, the processing for carrying out the first optimum point selecting method as shown in FIG. 19 is carried out.

Figure 22A:
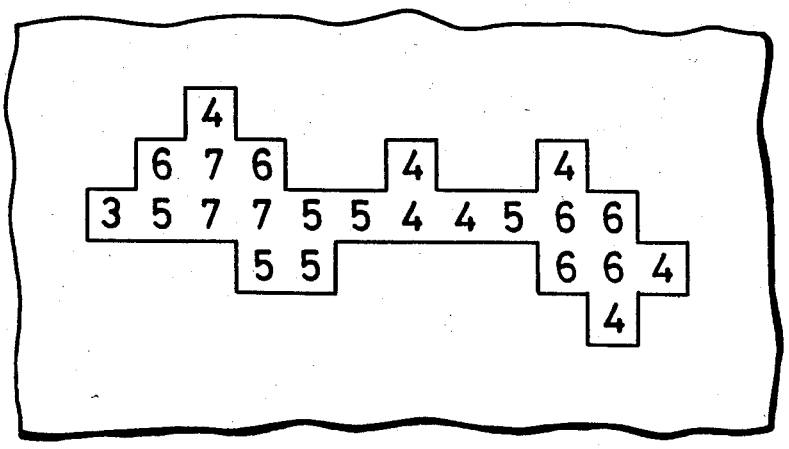
FIGS. 22A and 22B are respectively diagram useful for explaining a third embodiment of the optimum point selecting method according to the present invention.
Figure 22B:
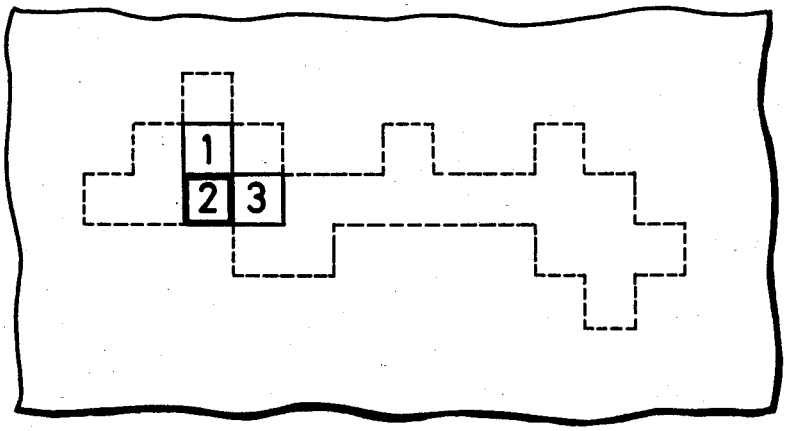

The third example of the method in which the optimum point is selected from the bits representing the aperture on the picture image data in the step just before the aperture is fulfilled by the shrinking process may be considered as follows. In the method of the third example, the square area of 3×3 bits is set, and a process for assigning the number same as the number of bits "1" within the square area to the central picture element is carried out with the square area being moved in turn. Then, only the bit of the picture element assigned with the highest number is left. FIG. 22A is a diagram showing the numbers which are assigned to the picture elements belonging to the core aperture. FIG. 22B is a diagram showing a case in which only the bit assigned with the highest number is left. Then, the optimum point is selected from the remaining bits by the same method as that of the first example in the optimum point selecting method. In the third example, the position of the bit assigned with the number "2" as shown in FIG. 22B is recognized as the optimum wire insertion position.

As described above, various versions of the method for selecting the optimum point from the remaining bits after the aperture is shrinked may be considered.

The insertion position detecting method of the present invention is not limited to the detection of the insertion position in the case in which a material or body is inserted into the core aperture but can be applied to the detection of the insertion position in a case where a material is inserted into the spacing between the bodies and so on.

As described above, the winding apparatus for the toroidal core of the invention includes a core driving means for holding a toroidal core such that an axis of its aperture is made in parallel to X-axis direction, moving the core in X-axis direction and Z-axis direction and rotating the same around Y-axis in clockwise or counterclockwise direction, a clamp driving means for holding first and second clamps which hold a free end portion of a wire at the position displaced from the center of rotation on one rotary surface vertical to the Y-axis and properly spaced apart from each other in its radius direction, rotating the two clamps with a constant positional relation therebetween in the clockwise or counter-clockwise direction and moving the same in the X-axis direction and Z-axis direction, a first pulley located at the position properly spaced apart to one side along the X-axis direction from the toroidal core held by the core driving means and changed in position by a position control section, a second pulley located at the opposite side to the first pulley with respect to the toroidal core held by the core driving means and changed in position by the position control section, a first video camera located at the side opposite to the toroidal core along the X-axis direction with respect to the first pulley and a second video camera located at the side opposite to the toroidal core with respect to the second pulley. The clamp driving means is formed to be capable of driving the first and second clamps to open and to close independently, driving the first clamp to move in the X-axis direction and the Y-axis direction and driving the second clamp to move in the Y-axis direction. The first and second video cameras are disposed in such a manner that their optical axes are both in parallel to the X-axis and that they are spaced apart from each other by a predetermined distance therebetween in the Z-axis direction. Then, the free end portion of the wire held by the first clamp and the aperture of the toroidal core are picked up by the first and second video cameras so as to detect the positions thereof. Thus, according to the present invention, the wire can automatically be wound around the toroidal core TC rapidly and surely.

According to another aspect of the present invention, there is provided a method for detecting a proper insertion position upon inserting a material into an aperture, a clearance or the like, which comprise the steps of picking up a picture of an aperture, a clearance and so on, converting a signal obtained by the pick-up to the form of a binary coded signal to provide such picture image data formed of the binary coded video signal of large number bits which consists of one signal representing the aperture, clearance and the like and the other signal representing other portion than the aperture, clearance and the like, when there exists even one bit in the signals representing other portion than the aperture, clearance and the like within a rectangular area of m×n bits (m and n are both desired integers and m=n may be possible)for the picture image data, changing a particular bit previously determined within the rectangular area to a signal representing other portion than the aperture, clearance and the like regardless of the content of the signal over the whole area of the picture image data with the position of the rectangular area being changed in turn to thereby shrink the aperture, clearance and the like on the picture image data, repeating the shrinking process until the aperture on the picture image data is lost, and selecting one bit from the bits remaining as the signal representing the aperture, clearance and the like on the picture image data at the step just before the aperture, clearance and so on are lost, whereby to recognize the position of that bit as a proper position at which the material is inserted into the aperture, clearance and the like. According to the insertion position detecting method, the insertion position is selected from the portion which is most distant from the peripheral edge of the aperture, clearance and the like. As a result, even if the insertion apparatus has a small error, the object can be inserted into the clearance.

In addition, according to the insertion position detecting method of the invention, when a plurality of apertures, clearances and so on are subjected to the shrinking process, the largest aperture, clearance and the like can not be fulfilled to the last. As a result, it becomes possible for the object to be inserted first into a large aperture, clearance and the like into which the object is easily inserted.

The above description is given on the preferred embodiments of the invention, but it will be apparent that many modifications and variations could be effected by one skilled in the art without departing from the spirits or scope of the novel concepts of the invention, so that the scope of the invention should be determined by the appended claims only.

We claim as our invention:

1. An apparatus for winding a wire around a toroidal core comprising:

a core holding means for supporting a toroidal core, moving the same in the directions of first and second axes and rotating the same;

first and second clamp means for clamping one end of a wire;

a clamp driving means for holding said first and second clamp means and moving the position thereof in the directions of said first and second axes and rotating the same;

a wire holding means positioned near said toroidal core for supporting said wire;

a detector means for detecting the position of said wire and the aperture of said toroidal core; and a control means for controlling said core holding means and said clamp driving means by the output from said detector means.

2. An apparatus according to claim 1, wherein said detector means includes first and second video cameras being aligned substantially parallel to said first axis.

3. An apparatus according to claim 1, wherein said clamp driving means opens and closes said first and second clamp means independently, and moves said first clamp means in the directions of the first and a third axes and moves said second clamp means in the direction of the second axis.

4. An apparatus according to claim 1, wherein said clamp driving means is further adapted to move said clamp means in the direction of a third axis and wherein said first, second and third axes represent X, Y and Z axes, respectively.

5. An apparatus according to claim 2, wherein said first and second video cameras each have an optical axis parallel to said first axis and both cameras are positioned with a predetermined distance therebetween in said second axis direction.

6. An apparatus according to claim 2, wherein said control means further comprises:

means for generating binary data from the output signal of said video camera, said binary data having a signal representing an aperture and a signal representing a non-aperture;

means for shrinking the area of said signal representing the aperture; and means for determining the position to insert said wire.

* * * * *